US005603659A

United States Patent [19]

Okada

[11] Patent Number: 5,603,659

[45] Date of Patent: Feb. 18, 1997

[54] GAMING MACHINE

[75] Inventor: Kazuo Okada, Tokyo, Japan

[73] Assignee: Universal Sales Co., Ltd., Tokyo, Japan

[21] Appl. No.: 286,963

[22] Filed: Aug. 8, 1994

[30] Foreign Application Priority Data

Mar. 11, 1994 [JP] Japan ..... 6-066548

[51] Int. Cl.[6] ..... A63F 9/00

[52] U.S. Cl. ..... 463/25; 463/16; 273/171 B

[58] Field of Search ..... 273/121 B, 143 R, 273/138 R, 138 A, 856; 463/25, 16

[56] References Cited

U.S. PATENT DOCUMENTS 5,275,400 1/1994 Weingardt et al. ..... 273/85 G

FOREIGN PATENT DOCUMENTS 4071582 3/1992 Japan ..... 273/121 B
5103868 4/1993 Japan ..... 273/121 B

*Primary Examiner*—Jessica Harrison
*Assistant Examiner*—James Schaaf
*Attorney, Agent, or Firm*—Rohm & Monsanto

[57] ABSTRACT

A game is played on a gaming machine by the use of gaming media which are increased or decreased depending on results of a play of the game. A first gaming value is defined as a value of the gaming media given to a player. The first gaming value is converted into a second gaming value defined as rights of the player for playing the game, at a first conversion factor. A second conversion factor for converting the second gaming value into the first gaming value is set independently of the first conversion factor.

21 Claims, 16 Drawing Sheets

GAMING MACHINE

BACKGROUND OF THE INVENTION

1. Field of the Invention

This invention relates to a gaming machine, including a slot machine and a ball-shooting game machine such as a pachinko game machine or a pin-ball game machine, and more particularly to a gaming machine in which profits obtained through plays of a game by players are reconciled with profits to be secured by a chance hall, while increasing the fun of playing the game.

2. Description of the Prior Art

In chance halls, such as casinos, where slot machines are installed, and pachinko shops, where ball-shooting game machines and other gaming machines are installed, players as customers generally play games on the gaming machines by the use of gaming media, such as coins as currency, or medals or pin balls (pachinko balls) purchased for cash, and exchange the gaming media acquired through winning plays in the games for predetermined prizes or currency other than the coins corresponding in value to the gaming media.

The probability of winning plays or the ratio of payout (ratio of a total number of medals, pin balls, or the like, acquired by a player through playing the game on a flaming machine, to a total number of medals, pin balls, or the like, put into the gaming machine by the player) is normally set or adjusted by means of setting means, such as switches, to a value less than 100% so as to permit the chance hall side to make profits. Further, to permit the chance hall side to make more profits, there are cases in which the value of each medal or pin ball purchased by the player at the start of the game is not equal to that of the same medal or pin ball exchanged for the prizes or money after the game.

Further, even in gambling houses, i.e. casinos, in which slot machines, poker game machines, and the like are installed, players as customers play games on gaming machines by the use of coins as currency or tokens (substitute currency) exchanged for cash, and are awarded with coins through winning plays in the game, or with the tokens acquired through winning plays in same for exchange for cash. In such gambling houses, the payout ratio of coins or tokens is set to a value less than 100%, usually approximately to 85%.

Further, ball shooting game machines, such as a pachinko game machine and an arrange ball game machine, are known as other gaming machines in which players use gaming media similar to coins. A pachinko game is a kind of pin ball game and well-known itself. One of such ball-shooting game machines is a ball-enclosed type in which playing balls (pachinko balls or pin balls) are enclosed for use in the game, and a player is supplied a predetermined number of playing balls according to the value of the gaming media put into the gaming machine when he starts playing the game. The player plays the game by the use of these playing balls.

More specifically, an effective value, such as the number of coins inserted by the player or the number of permitted plays of the game stored in a prepaid card, is displayed as credit, and the player is permitted to play the game the number of times corresponding to the numerical value of the credit. For example, assuming that twenty playing balls (pin balls enclosed within the pachinko game machine) are supplied per coin put in the gaming machine, when the player has used up these playing balls, one game is over. If there occur winning plays during the game, he receives a number of coins depending on the type of a win as credit, and is permitted to continue the game over the number of times corresponding to the number of coins given as credit. The number of such coins acquired through winning plays in the game is displayed on the machine separately from the numerical value of credit given by coins put into the machine.

However, if the ratio of payout is set to a value less than 100% in the above-mentioned type of gaming machine, although a player can win in succession during the game to some extent, the probability of winning plays is low as a whole, which makes the player uninterested in the game in the course of time. Particularly, in a gaming machine adapted to give a chance of winning a big prize or a so-called big bonus game during which the machine is set to an operating mode quite advantageous to the player, the player's interest is directed to a coming occurrence of the big bonus game. However, the big bonus game, probability of which is determined in accordance of the payout ratio, rarely occurs, which tends to make the player uninterested in the game on the contrary.

Therefore, this can result in a problem of a reduced rate of operation of gaming machines, which is inconvenient to the chance hall. Inversely, if the ratio of payout is increased to improve the ratio of operation of the machines, profits obtained by the chance hall through the games are reduced.

Further, a player also feels disadvantageous, if the value of gaming media purchased when he starts to play the game is not equal to the value of the same exchanged for prizes or money, so that he tends to eventually become uninterested in the game.

SUMMARY OF THE INVENTION

It is the object of the invention to provide a novel gaming machine which satisfies both requirements of profits to be secured by a chance hall and fun of playing a game large enough to make players interested in the game, whereby a player is made more interested in the game and the chance hall side can also make profits therefrom.

To attain the above object, according to a first aspect of the present invention, there is provided a gaming machine for playing a game by the use of gaming media which are increased or decreased depending on results of a play of the game.

The gaming machine according to the first aspect of the invention is characterized by comprising conversion factor setting means for setting, independently of a first conversion factor for converting a first gaming value defined by a value of the gaming media given to a player into a second gaming value defined by rights of the player for playing the game, a second conversion factor for converting the second gaming value into the first gaming value.

Preferably, the gaming machine includes switch means for selecting one of a plurality of predetermined values as desired, to thereby set the first conversion factor.

Alternatively, the gaming machine may include means for determining the first conversion factor by sampling a random number.

Preferably, the conversion factor setting means includes switch means for selecting one of a plurality of predetermined values as desired, to thereby set the second conversion factor.

Alternatively, the gaming machine may include means for determining the second conversion factor by sampling a random number when the second gaming value is increased or decreased.

Preferably, the gaming machine includes first display means for displaying the second gaming value, and second display means for displaying the first gaming value.

Preferably, the gaming machine includes first converting means for converting the first gaming value into the second gaming value at the first conversion factor, and second converting means for converting the second gaming value into the first gaming value at the second conversion factor.

More preferably, the gaming machine includes first display means for displaying the second gaming value as results of conversion by the first converting means, and second display means for displaying the first gaming value as results of conversion by the second converting means.

Further preferably, the first display means displays the maximum possible number of plays permitted, and the second display means displays the number of the gaming media.

Preferably, the first gaming value is measured in the number of gaming media, and the second gaming value is measured in the maximum possible number of plays permitted.

For example, the gaming media are medals or coins.

In one form, the game is played by the use of playing balls which are increased or decreased in number depending on results of a play of the game, and the maximum possible number of plays permitted corresponds to the number of the playing balls.

The playing balls may be used as the gaming media, and in this case the first conversion factor is equal to 1.

Preferably, the gaming machine includes means for paying out a number of gaming media corresponding to the first gaming value to the player, when a predetermined adjustment condition has been satisfied during the game.

When a number of the gaming media corresponding to the first gaming value are paid out to the player, the game may be permitted to be continued unless the remaining value of the second gaming value is equal to 0.

According to a second aspect of the invention, there is provided a gaming machine for playing a game by the use of gaming media which are increased or decreased depending on results of a play of the game.

The gaming machine according to the second aspect of the invention is characterized by comprising:

means for increasing or decreasing the maximum possible number of plays of the game depending on results of a play of the game;

means for converting the gaming media into the maximum possible number of plays of the game at a first conversion factor; and means for converting the maximum possible number of plays of the game into the number of the gaming media at a second conversion factor which is set independently of the first conversion factor.

The above and other objects, features, and advantages of the invention will become more apparent from the following detailed description taken in conjunction with the accompanying drawings.

DETAILED DESCRIPTION OF THE PREFERRED EMBODIMENTS

Figure 1:
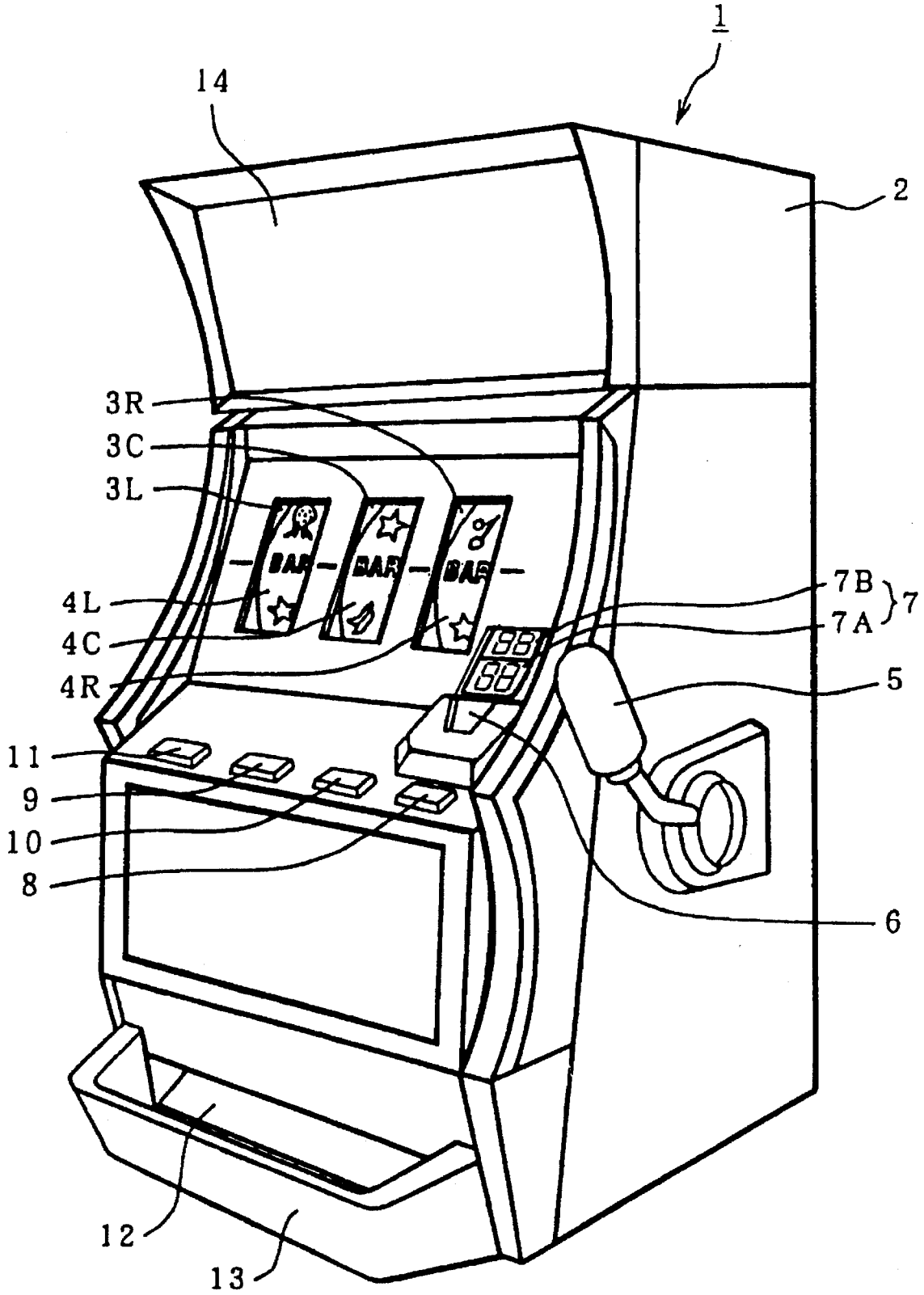
FIG. 1 is a perspective view showing an appearance of a slot machine according to a first embodiment of the invention.

FIG. 1 shows an appearance of a slot machine according to a first embodiment of the invention. In the figure, reference numeral 1 generally designates a slot machine as a gaming machine adapted to permit players, to play the game by the use of coins, medals, or other tokens as gaming media. In the following description, it is assumed that medals are used in the game.

First, reference numeral 1 generally designates the slot machine 1 the whole of which is enclosed in a cabinet 2 having three display windows 3L, 3C, and 3R formed in a front face thereof for displaying various kinds of symbols therethrough at respective upper, central, and lower positions in each window. Theses symbols are painted on a sheet forming a peripheral surface of each of three rotating reels 4L, 4C, and 4R arranged within the cabinet 2 behind the respective display windows 8L, 8C, and 8R. A start lever 5 is arranged at a side wall of the cabinet 2 in a manner rotatable through a predetermined range of angle, for permitting a player to operate same to cause the reels to start rotating.

At a location below the display windows to the right thereof, there are provided a medal entry slot 6 for inserting medals as gaming media into the slot machine, and a display block 7 for displaying the number of medals inserted into the machine for a deposit via the medal entry slot 6, or the number of medals acquired by plays, the number of medals deposited as credit, etc. The display block 7 consists of a local credit display 7A and a bank credit display 7B, each of which is formed by a desired number of 7-segment LED's (light emitting diodes) (four LED's, for example, are capable of designating up to four digits of numerical values). In this connection, means for display is not limited to LED's, but may be implemented by LCD (liquid crystal display) elements or the like, as desired.

Below the display windows 3L, 3C, and 3R, there are provided a spin switch 8 for starting to drive the reels into rotation by a button-pushing operation instead of operating the start lever 5, a 1-bet switch 9 for betting only one unit value (corresponding to a numerical value of 1) of a second gaming value, defined hereinbelow, on a single play, a maximum-bet switch 10 for betting the maximum of the second gaming value permitted to be bet on a single play, a C/P (credit/payout) switch 11 which is operated by a button-pushing operation for a changeover between the credit and the payout of medals acquired by the player, and a medal tray 13 for receiving medals paid out via a medal chute 12. Further, an upper panel on the front face of the cabinet 2 is provided with a payout table showing winning plays and corresponding number of medals paid out as awards.

In this embodiment, the number of gaming media (medals in the present embodiment) given to a player is referred to as "local credit", and is represented specifically by the number of medals to be actually paid out. In the present specification, "the first gaming value" is defined as the value of the gaming media. Further, rights of playing the game possessed by the player is referred to as "bank credit", and is represented specifically by the maximum possible number of plays permitted. In the present specification, "the second gaming value" is defined as the rights of playing the game possessed by a player. The unit value of the second gaming media is equal to the minimum value thereof required to be bet on a single play. which corresponds to a numerical value of 1 of the bank credit.

At the display block 7, the local credit display 7A displays, as the local credit, the number of medals inserted into the machine by the player when the game is started, and then, a numerical value obtained by converting the bank credit (in the present case, the maximum possible number of plays permitted) into the number of medals at a second conversion factor $R_2$. On the other hand, the bank credit display 7B displays, as the bank credit, a numerical value obtained by converting the number of medals inserted into the machine into the number of unit values of the second gaming media, i.e. the maximum possible number of plays permitted, at a first conversion factor $R_1$, at the time of insertion of medals, and thereafter a value of the maximum possible number of plays permitted which is increased by winning plays or decreased by losing plays.

Here, the first conversion factor $R_1$, is defined as a ratio ($L/B=R_1$,) of conversion applied when converting the number of medals inserted (local credit L) into the bank credit B, while the second conversion factor $R_2$ is a ratio ($L/B=R_2$) Of conversion applied when converting the bank credit B into the number of medals to be paid out (local credit L). These factors or ratios are set as shown below in Table 2 and Table 3.

The present embodiment is characterized in that the first conversions ratio $R_1$, for converting the first gaming value (local credit) into the second gaming value (bank credit) applied when the player inserts medals into the machine, and the second conversion factor $R_2$ for converting the second gaming value (bank credit) increased or decreased during the game into the first gaming value (local credit) can be set to different values (i.e. these conversions are not equivalent to each other). These conversion factors are set, as will be described herein, by means of respective conversion factor switches operated when the machine starts to be put into operation in a chance hall, or alternatively determined by random number sampling, i.e. by selecting from a predetermined plurality of numerical values by the use of a random number.

Figure 2:
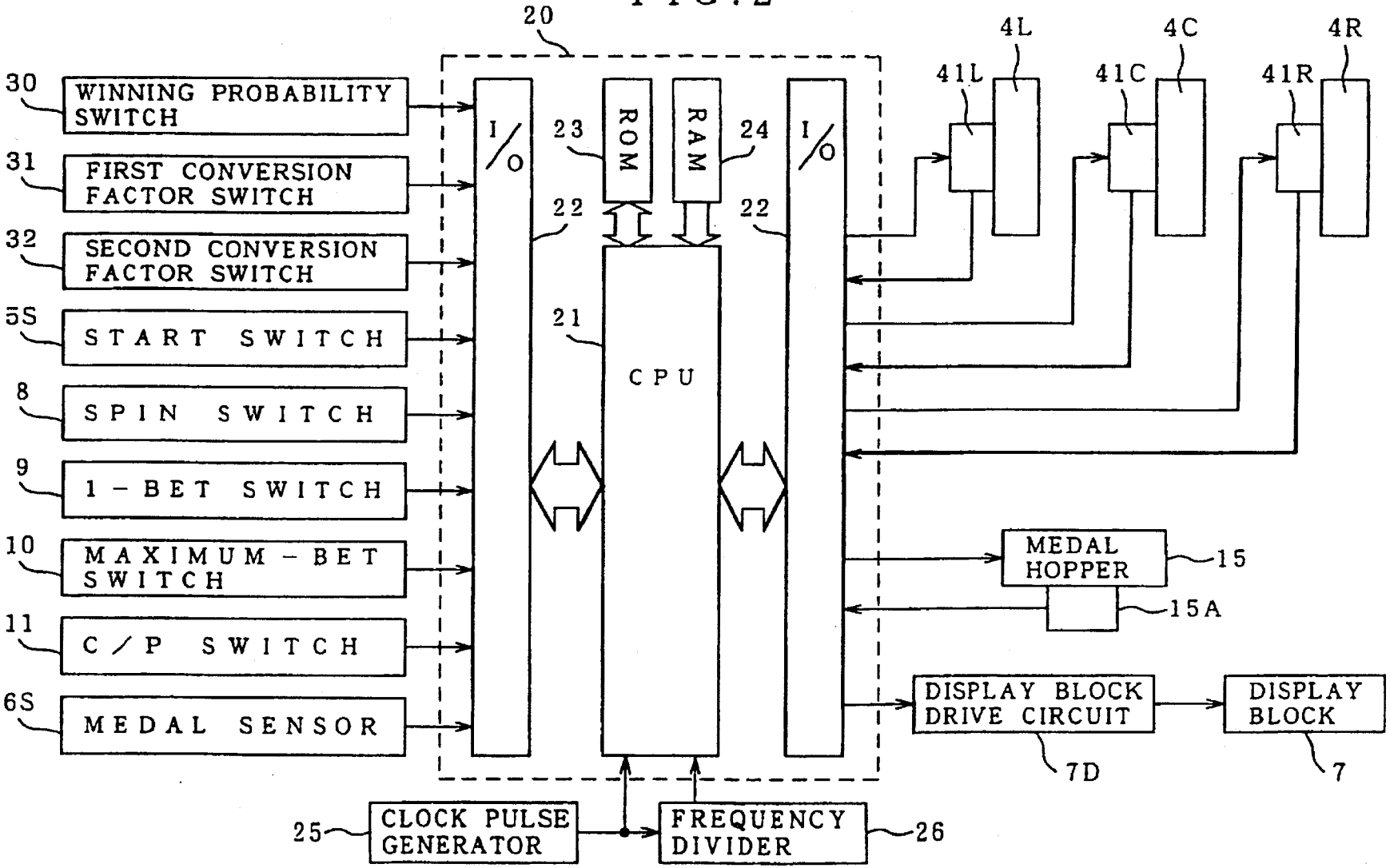
FIG. 2 is a diagram showing a configuration of a control circuitry used in the slot machine shown in FIG. 1.

FIG. 2 shows a control circuitry of this embodiment. This control circuitry operates under the control of a microcomputer 20. The microcomputer 20 is comprised of a CPU (central processing unit) 21, I/O ports (input/output ports) 22, 22, a ROM (read only memory) 23, and a RAM (random access memory) 24. Further, connected to the CPU 21 are a clock pulse generator 25 for delivering reference clock pulses (e.g. at a frequency of 4 MHz) to the CPU 21, based on which the CPU 21 operates, and a frequency divider 26 for delivering interruption pulses (e.g. at a frequency of 500 Hz) for enabling an interruption by a predetermined program for execution thereof.

In addition to signals from the above mentioned switches 8 to 11, the microcomputer 20 is supplied via the I/O ports 22, 22, signals from a start switch 5S, a medal sensor 6S for detecting inserted medals, a wining probability switch 30, a first conversion factor switch 31, and a second conversion factor switch 32 (which is omitted, when the above-mentioned random number sampling is performed). Further, signals from reel position sensors, not shown, incorporated within pulse motors (or stepping motors) 41L, 41C, and 41R for driving the rotating reels 4L, 4C, and 4R, respectively, and a payout medal sensor 15A for detecting medals paid out from a medal hopper 15 are also input via the I/O ports 22, 22 to the CPU 21.

Among the above sensors and switches connected to the microcomputer 20, the medal sensor 6S detects proper medals inserted via the medal entry slot 6 appearing in FIG. 1 and selected by a medal selector, not shown, and may be suitably formed by a contact type detector, such as a microswitch, as well as a non-contacting type, such as a magnetic sensor or an optical sensor.

The start switch 5S, which is turned on or off in an interlocked manner with operation of the start lever 5, generates a start signal for starting to drive the reels into rotation when the player has pulled the start lever 5.

The C/P switch 11 is arranged, as described hereinabove, at the front face of the machine, and is manually operated for a changeover between the credit side and the payout side.

In the present embodiment, the number of medals as the local credit and the maximum possible number of plays permitted as the bank credit are displayed on the respective displays, and so long as the player holds the C/P switch set at the credit side, no medals are paid out for winning plays, but the bank credit and the local credit corresponding thereto are increased instead. On the other hand, when the C/P switch is changed over to the payout side, the CPU 21 determines whether the bank credit is equal to or higher than a lower limit value for payout of a medal. If the answer to this question is affirmative (YES), medals are paid out in a number which is equal to the local credit converted from the bank credit. If the answer is negative (NO), no medals are paid out, while permitting the player to continue the game depending on an amount of the remaining bank credit.

The winning probability switch 30 is provided for setting a ratio of a total amount of the second gaming value paid out to the player for winning plays to a total amount of the second gaming value bet on the game by the player, i.e. a payout ratio, which is determined by a probability of occurrence of winning plays, through selection from two or a larger number of predetermined numerical values. This kind of setting switch can be constructed, for example, such that a unit of the control circuitry arranged at the bottom of the cabinet 2 is formed with a keyhole for insertion of a key for operating the switch, and the key inserted is turned right or left, thereby setting a stage of the probability. The switch 30 sets the winning probability, i.e. the payout ratio. Depending on the winning probability set by the switch 30, one of winning probability tables (stored in the ROM) is determined for use in determination of winning plays (carried out at a step ST8 of FIG. 3, referred to hereinafter).

The stages of the winning probability are set, e.g. as shown in Table 1.

TABLE 1

| Stage | Winning Probability (Payout ratio) |
|---|---|
| 1 | 95% |
| 2 | 100% |
| 3 | 105% |
| 4 | 110% |
| 5 | 115% |
| 6 | 120% |

The first conversion factor switch 31 is provided for setting the first conversion factor $R_1$ for calculating the second gaming value (bank credit) per medal inserted by the player, by selecting from two or a larger number of predetermined values, e.g. when the game machine is put into operation in the chance hall. This switch can be also suitably implemented by a keyhole type, similarly to the winning probability switch 30, and is provided in the unit of the control circuitry.

The stages of the first conversion factor $R_1$ are set, e.g. as shown in Table 2.

TABLE 2

| Stage | $R_1$ (= L/B) |
|---|---|
| 1 | 1/1.0 |
| 2 | 1/1.2 |
| 3 | 1/1.4 |
| 4 | 1/1.6 |
| 5 | 1/1.8 |
| 6 | 1/2.0 |

The second conversion factor switch 32 is provided for setting the second conversion factor $R_2$ for converting the profits (bank credit) acquired by the player into the first gaming value (local credit) represented by the number of medals to be actually paid out by selecting from two or a larger number of predetermined values, e.g. when the machine is put into operation,. This switch can be also constructed and arranged in a manner similar to the first conversion factor switch 31.

The stages of the second conversion factor $R_2$ are set, e.g. as shown in Table 3.

TABLE 3

| Stage | $R_2$ (= L/B) |
|---|---|
| 1 | $R_1 \times 100/100$ |
| 2 | $R_1 \times 95/100$ |
| 3 | $R_1 \times 90/100$ |
| 4 | $R_1 \times 85/100$ |
| 5 | $R_1 \times 80/100$ |
| 6 | $R_1 \times 75/100$ |

The above two conversion factor switches 31 and 32 can be formed by one switch for common use, such that the first conversion factor $R_1$ is set when a key inserted into a keyhole is turned right or left, whereas the second conversion factor $R_2$ is set when the key is turned in an opposite direction to that for the first conversion factor, i.e. left or right.

According to the examples described above, assuming that the first conversion factor switch 31 is set to a stage "2", and the second conversion factor switch 32 to a stage "5", the player acquires 1.2 (unit values of the second gaming media) as the bank credit per medal inserted into the machine. Then, if the bank credit is equal to 100 when medals are to be paid out Cat the time of adjustment), 66 medals are actually paid out, since $100\times1/1.2\times0.8=66.66\ldots$. Further, the play can be continued since there is a remainder ($0.66\ldots\times1.2\times1/0.8=1.0$) of the bank credit corresponding to fractions (0.66) of local credit.

The setting for cases where the remainder of the bank credit is smaller than 1 can be made such that the Fractions are rounded up to 1, thereby permitting one more play, or alternatively , such that they are ignored, thereby terminating the game.

When the above conversion factors $R_1$, and $R_2$ are set by the random number sampling instead of manual setting operations by the use of switches, one of the plurality of the stages of each of them is determined by a value selected by random number sampling performed by the CPU 21. Further, the second conversion factor $R_2$ may be determined such that the CPU 21 causes a setting value to circulate through a plurality of setting stages periodically, thereby determining one of the setting stages in synchronism with timing of occurrence of a winning play. In this case, the control is performed such that the payout ratio of the machine is finally converged to a value set by the winning probability switch 30.

The CPU 21 of the microcomputer 20 is supplied with signals from the aforementioned various sensors and switches, and writes them as data into the RAM 24.

The microcomputer 20 delivers drive control signals to the pulse motors 41L, 41C, and 41R, for control of rotation of the rotating reels 4L, 4C, and 4R driven thereby, a payout signal to the medal hopper 15 for causing same to pay out medals, and a display control signal to a display block drive circuit 7D for control of display of the display block 7 described above.

In the present embodiment, the first conversion factor switch 31 and the microcomputer 20 constitute first converting means for converting the effective value of gaming media (the number of medals inserted by the player) into the second gaming value (bank credit) at the first conversion factor $R_1$, while the second conversion factor switch 32 and the microcomputer 20 constitute second converting means for converting the second gaining value (bank credit) into the first gaming value (local credit) at the second conversion factor $R_2$, when a predetermined winning play occurs during the game.

Next, there will be described gaming operations performed by the slot machine 1 under the control of the control circuitry shown in FIG. 2.

Figure 3:
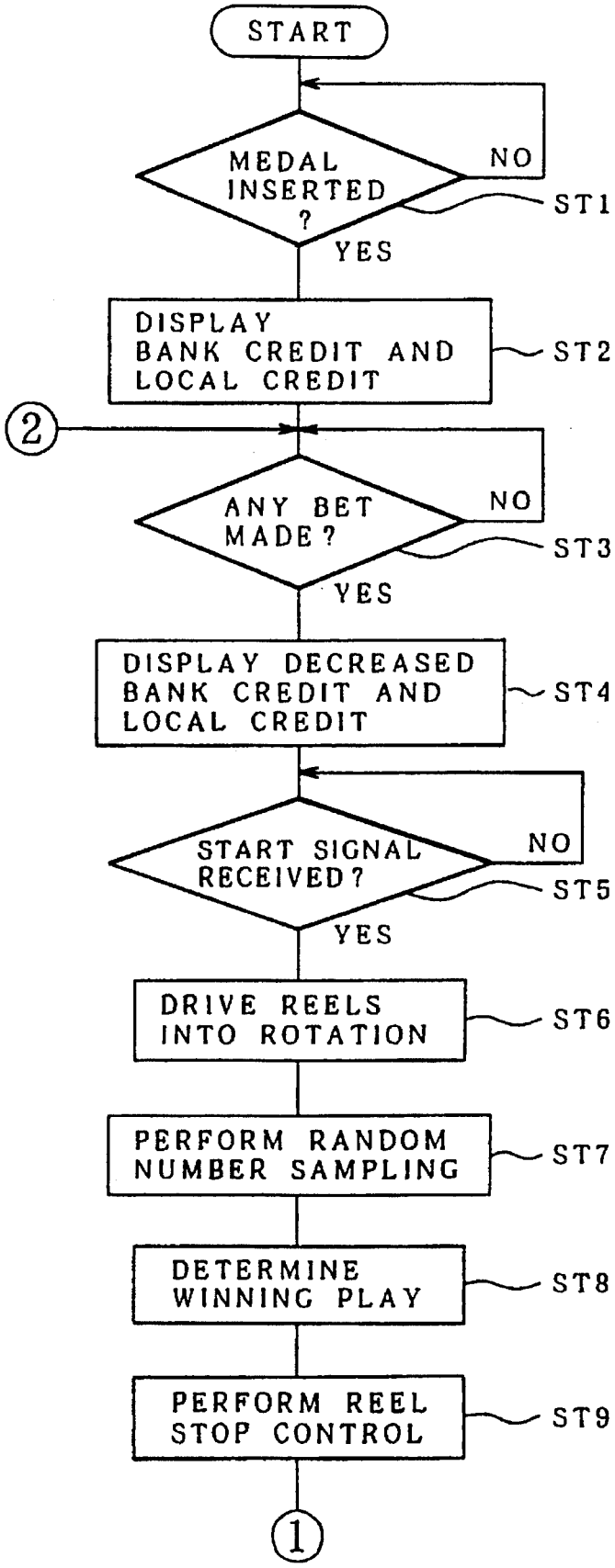
FIG. 3 is a flowchart of a program for gaming operations performed by the control circuitry shown in FIG. 2.

Referring to FIG. 3, the CPU 21 determines at a step ST1 whether or not a medal is inserted. The answer to this determination becomes affirmative (YES) when a medal is inserted into the medal entry slot 6 and the medal sensor 6S has delivered a signal to the CPU 21. If the answer is affirmative (YES), the local credit and the bank credit are displayed at a step ST2. More specifically, the number of medals inserted into the machine is displayed on the local credit display 7A, while a numerical value converted from the number of these medals at the first conversion factor $R_1$ is displayed on the bank credit display 7B.

Then, it is determined at a step ST3, whether or not the betting is carried out. The answer to this question becomes affirmative (YES) when a signal from the 1-bet switch 9 or the maximum-bet switch 10 is input to the CPU 21. Depending on the kind of a bet, the local credit and the bank credit after subtraction are displayed at a step S4. More specifically, when a signal from the 1-bet switch 9 is received, a value of the bank credit updated by subtraction of 1 and a value of the local credit updated accordingly are displayed at the display block. When a signal from the maximum-bet switch 10 is received, a value of the bank credit updated by subtraction of a numerical value equal to the maximum of bank credit permitted to be bet on a single play and a value of the local credit updated accordingly are displayed at the display block 7.

Then, it is determined at a step ST5 whether or not the start signal (in the present embodiment, a signal from the start switch 5 or the spin switch 8 ) is received. If the answer to this question is affirmative (YES), the reels 4L, 4C, and 4R are driven for rotation at a step STG, and then the random number sampling is performed at a step ST7. In the random number sampling, an integer stored within a register in the CPU 21 is changed within a predetermined range (e.g. 0 to 127) whenever a reference clock pulse is received from the clock pulse generator 25. Then, during an interval between one interruption and the following interruption, a numerical value obtained by adding a predetermined number (e.g. 3) to this integer is stored in the RAM 24, and the resulting numerical value stored in the RAM 24 is read out whenever the interruption operation occurs, thereby effecting the random number sampling. The numerical value stored in the RAM 24 is updated during an interval between one interruption and the following interruption.

Then, it is determined at a step ST8 whether or not a winning play has occurred based on the random number value sampled or read out from the RAM 23. The determination of a winning play is performed by comparing the sampled random number value with a winning probability table stored within the ROM 23 selected for use to thereby determine a kind of a winning play or a losing play. Depending on the result of comparison, a flag indicative of a kind of the winning play (e.g. one for a big prize called "big bonus", or one for a prize other than the big bonus) or one indicative of a losing play is set, based on which the reel stop control is performed at a step ST9. More specifically, the control is performed to cause the reels 4L, 4C, and 4R to stop at respective positions such that symbols in a winning combination corresponding to the flag are aligned on a winning line on the display windows 3L, 3C, and 3R.

Figure 4:
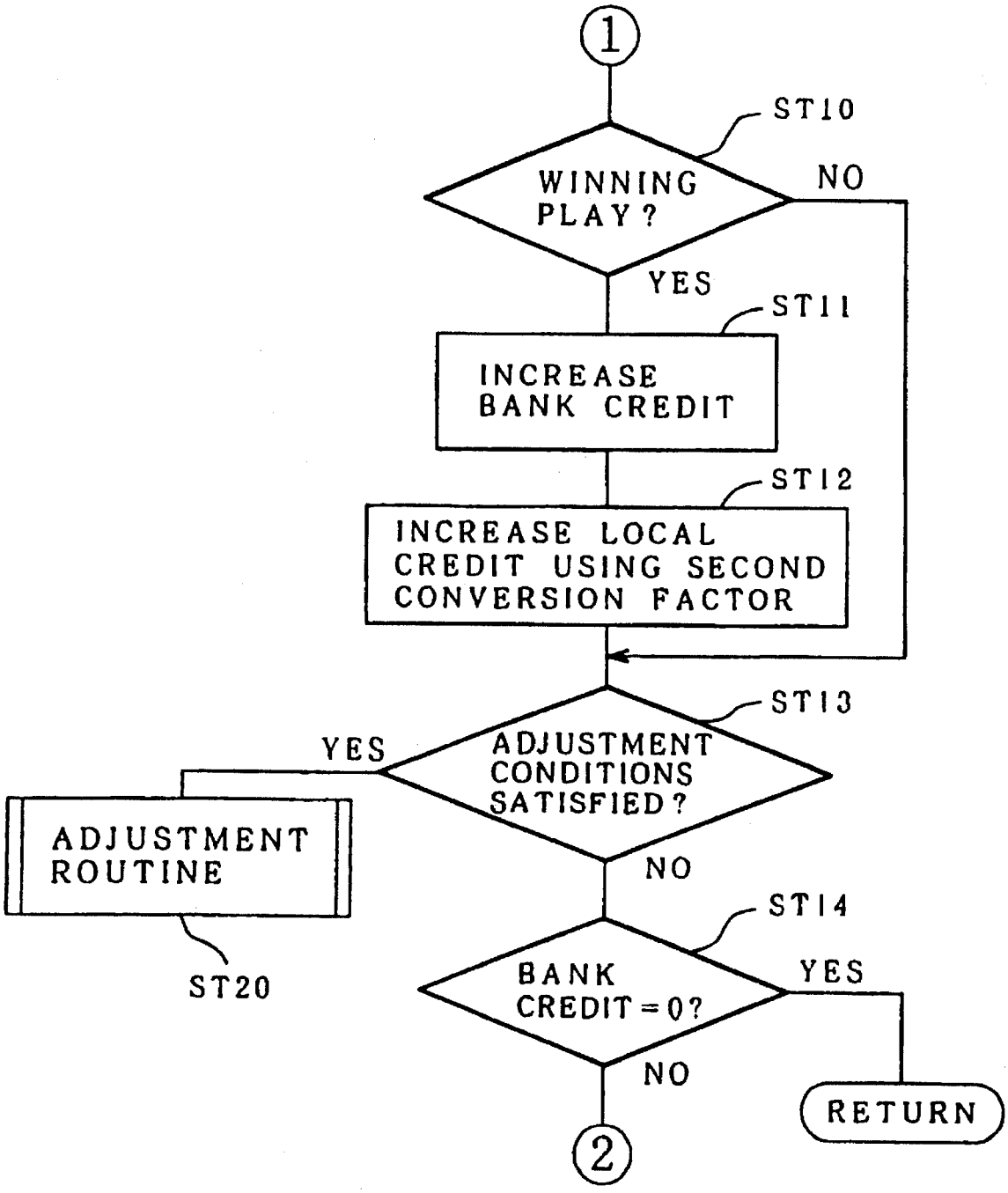
FIG. 4 is a continuation of the FIG. 3 flowchart.

Then, as shown in FIG. 4, it is determined at a step ST10 whether or not the present play was a winning play. If the present play was a losing play, the program proceeds to a step ST13 , where it is determined whether or not adjusting conditions, referred to hereinafter, have been satisfied. On the other hand, if the present play was a winning play, the bank credit is increased at a step ST11. More specifically, an awarded amount of the second gaming value (bank credit) shown in a award table 14 is added to the bank credit in proportion to the bet amount of the second gaming value, and the resulting sum is displayed on the bank credit display 7B.

Then, a numerical value calculated by converting the bank credit value after addition into the local credit at the second conversion factor $R_2$ is displayed on the local credit display 7A at a step ST12. In this connection, the second conversion factor $R_2$ is set when the gaming machine is put into operation in the chance hall, by means of the conversion factor switch 32, as described above, or alternatively, it is determined based on a random number value selected from a predetermined plurality of numerical values.

Then, it is determined at a step ST13 whether or not the adjustment conditions are satisfied. If the answer to this question is negative (NO), it is determined at a step ST14 whether or not the bank credit is equal to zero (0). If the answer to this question is affirmative (YES), the program returns to the step ST1, i.e. the start of the program shown in FIG. 3, whereas if the answer is negative (NO), the program returns to the step ST3 for determining whether or not a bet has been made.

Figure 5:
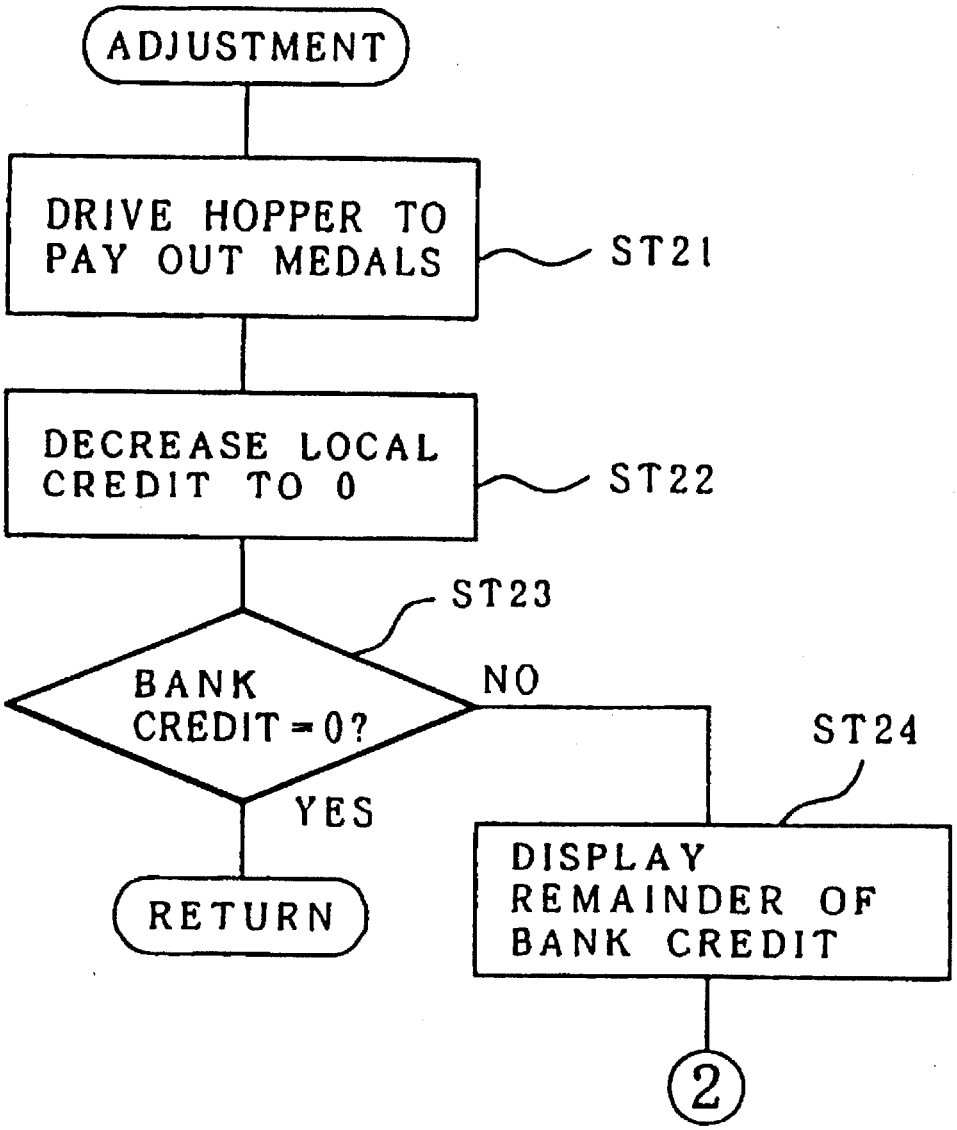
FIG. 5 is a flowchart of an adjustment routine executed in the FIG. 4 program.

On the other hand, if the adjustment conditions are satisfied at the step ST13, an adjustment routine shown in FIG. 5 is executed. The adjustment conditions are defined by one or a combination of the following cases: (1) The C/P switch 11 is changed over to the payout side. (2) The adjustment switch is turned on. (3) A predetermined time period has elapsed after the game is started by insertion of a medal. (4) The difference between a total number of medals inserted by the player and a total number of medals acquired by the players becomes equal to or larger than a predetermined value. The adjustment switch is an internal switch (software switch set by a program) which is automatically turned on by the CPU 21, when the big bonus has occurred a predetermined number of times (set in advance e.g. by a number of times-setting switch), and the final big bonus is terminated. Or alternatively, the random number sampling may be performed upon termination of each big bonus, and if a random number sampled is equal to one of predetermined values, the adjustment is not performed (i.e. permitting the bank credit to remain deposited for continuation of the game), and if not, the adjustment is performed to pay out medals corresponding in number to the local credit. These adjustment conditions may be adopted as desired.

Further, it is also possible to make the adjustment conditions easier to be satisfied as the winning probability set in advance is higher. In this case, the gaming machine which is set to a higher winning probability is more often subjected to adjustment of the credit, i.e. payout of medals.

Referring now to the adjustment routine shown in FIG. 5, the medal hopper 15 is driven to cause medals equal in number to the local credit are paid out to the medal tray 13 at a step ST21, and the local credit is finally set to 0 at a step ST22. Then, it is determined at a step ST23 whether there remains no bank credit. If the answer to this question is affirmative (YES), i.e. if there remains no bank credit, the program returns to the start of the program, i.e. the step ST1, whereas if the answer is negative (NO), the remaining value of the bank credit is displayed on the bank credit display 7B at a step ST24, followed by the program returning to the step ST3. In this connection, if it is set that the remainder, if any, of the bank credit, which is continue the game by the use of medals paid out.

According to the adjustment conditions described above, it is possible to timewise divide the game, and the number of medals paid out each time is converted from the bank credit at the second conversion factor $R_2$, enabling the chance hall side to secure profits.

Although the slot machine in the above embodiment is a rotating reel type, this is not limitative, the present invention may be applied to slot machines which use, as means for displaying symbols, a display device such as an LCD (liquid crystal display), an LED (light emitting diode) or a CRT (cathode ray tube).

Figure 6:
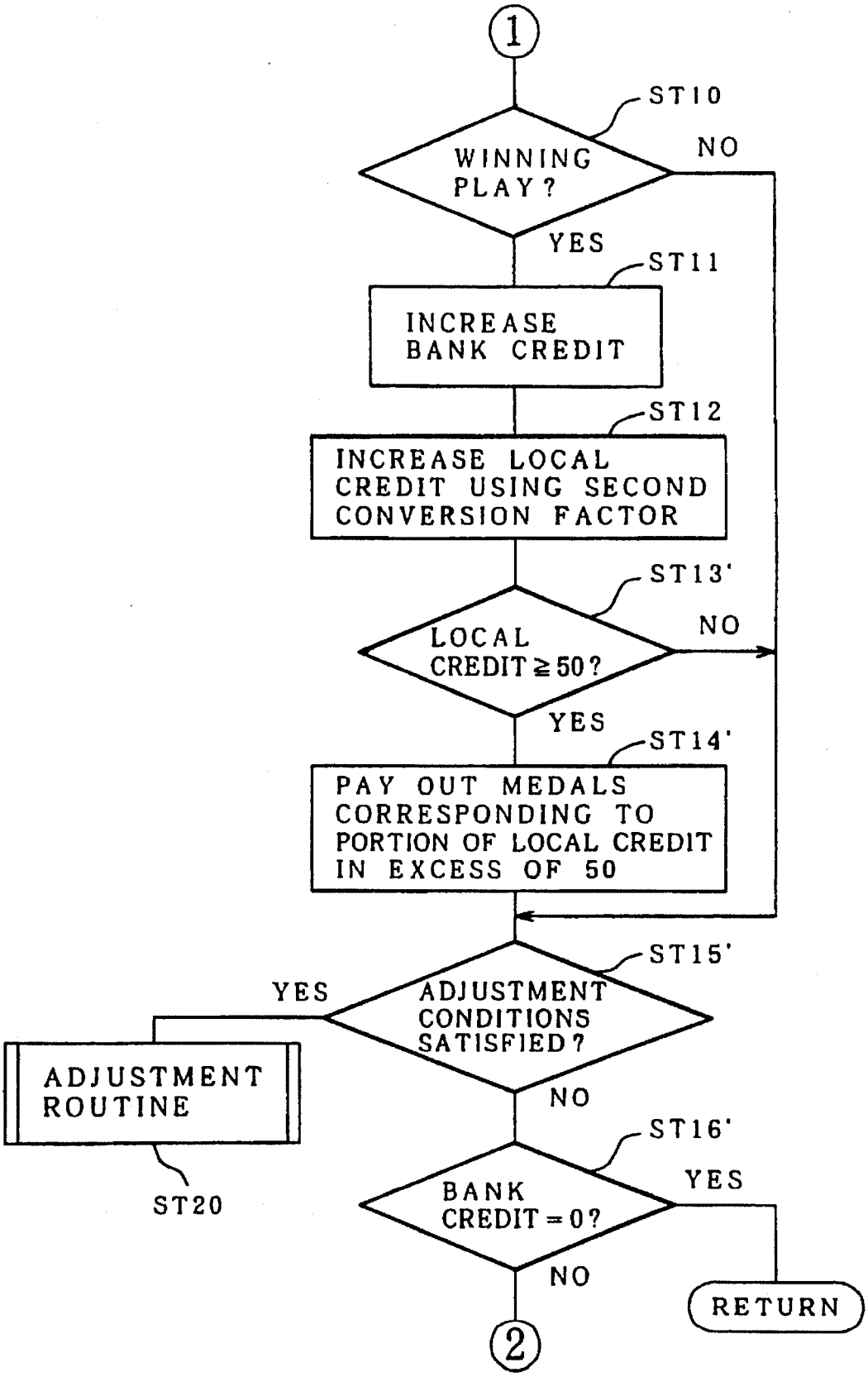
FIG. 6 is a flowchart of an adjustment routine executed instead of the FIG. 5 program by a pachinko slot machine to which the present invention is applied.

Further, the present invention can be applied to a slot machine (so-called pachinko-slot machine) for installation in pachinko shops, which is equipped with reel stop buttons. In this case, in the FIG. 3 program, a stop condition-determining step is inserted between the step ST8 and the step ST9 for determining whether or not the reel stop buttons are pushed or turned on, and further, operations subsequent to the step ST10 in FIG. 4 are changed as shown in FIG. 6.

More specifically, it is determined at the step ST1 in FIG. 3 whether or not a medal is inserted. If the answer is affirmative (YES), the local credit and the bank credit are displayed at the step ST2. Then, it is determined at the step ST3, whether or not a bet has been made. The local credit and the bank credit after subtraction depending on the kind of bet are displayed at the step ST4. Then, it is determined at the step ST5 whether or not the start signal (in the present case, a signal from a start switch for starting the rotating reels) is received. If the answer to this question is affirmative (YES), the reels 4L, 4C and 4R are driven for rotation at the step ST6, and then random number sampling is performed at the step ST7. Then, it is determined at the step ST8 whether or not a winning play has occurred, based on a random number sampled or read out from the RAM 23. Depending on the result of comparison, the reel stop control is performed at the step ST9, if the reel stop buttons are pushed, which is determined at the above-mentioned condition-determining step, not shown. Then, the program proceeds to the step ST10 shown in FIG. 6, where it is determined whether or not the present play was a winning play. If the present play was a losing play, the program proceeds to a step ST15', where it is determined whether or not adjusting conditions have been satisfied. On the other hand, if the present play was a winning play, the bank credit is increased at the step ST11. Then, a numerical value calculated by converting the bank credit value after addition into the local credit at the second conversion factor $R_2$ is displayed on the local credit display 7A at the step ST12.

In the case of pachinko-slot gaming machines, the credit normally has an upper limit value, and hence it is determined at a step ST13' whether or not the local credit has reached the upper limit value (e.g. 50). If the answer to this question is negative (NO), the program proceeds to the step ST15', whereas if the answer is affirmative (YES), medals corresponding to a portion exceeding the upper limit value are paid out, and the bank credit is decreased by subtraction at a step ST14'.

Then, it is determined at the step ST15' whether not the adjustment conditions are satisfied. If the answer to this question is affirmative (YES), the adjustment routine shown in FIG. 5 is carried out at the step ST20, whereas if the answer is negative (NO), it is determined at a step ST16' whether or not the bank credit is equal to zero (0). If the answer to this question is affirmative (YES), the program returns to the step ST1, i.e. the start of the program, whereas if the answer is negative (NO), the program returns to the step ST3, i.e. the bet-determining step.

As described above, in the slot machine according to the first embodiment, the second conversion factor $R_2$ for converting the profits (bank credit) acquired by the player through plays into the number of medals (local credit) to be actually paid out can be set to a value smaller than the first conversion factor $R_1$, applied when converting the number of medals inserted by the player into the bank credit. Therefore, the payout ratio during the game can be set to a value higher than 100%. As a result, the probability of occurrence of the big bonus can be set to a larger value to thereby increase the fun of playing the game. Accordingly, the rate of operation of the gaming machine can be increased without making players uninterested in the game, which leads to an increase in sales.

Further, the provision of the second conversion factor $R_2$ applied when the bank credit acquired by winning plays is converted into the number of medals makes the chance hall side less reluctant to make the conversion factor between medals and cash applied when medals are purchased equivalent to the conversion factor between them applied when the medals are exchanged for prizes or cash, which prevents players as customers from feeling disadvantageous, thereby making players more interested in the game.

Further, when the second conversion factor $R_2$ is determined by random number sampling, the conversion factor per se is varied, which makes it impossible for players to recognize the conversion factor, thereby increasing the fun of playing the game as compared with a case where the conversion factor is set to a fixed value by the use of a setting switch, and this is preferred from a viewpoint of management of a chance hall.

Figure 7:
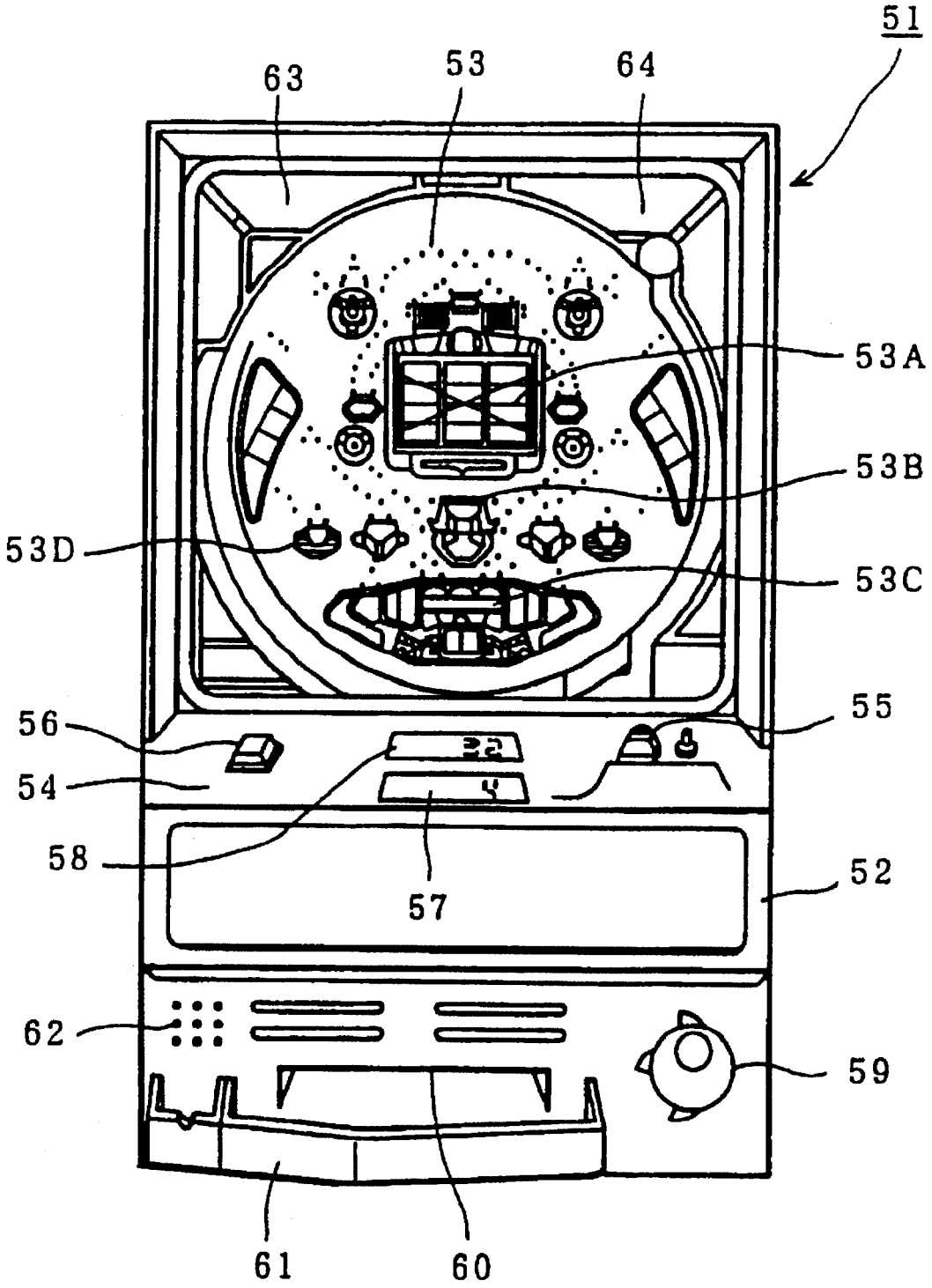
FIG. 7 is a perspective view showing an appearance of a pachinko game machine according to a second embodiment of the invention.

FIG. 7 shows a front face of ball-shooting game machine (pachinko game machine) according to a second embodiment of the invention.

Inside a glass window covering an upper part of a front door 52 of a ball-shooting game machine 51, there is arranged a game board 53 which is formed, on a front surface thereof, a variable display block 53A for playing a special game other than an ordinary game played by the use of pachinko balls (i.e. pin balls, hereinafter simply referred to as "balls"), as well as winning regions, such as a special winning hole 53B for starting the special game displayed on the variable display block 53A, a special winning device 53C (so-called attacker) which is opened when the special game terminated in a particular winning mode, or under other predetermined conditions, ordinary winning holes 53D, and other variable winning devices (socalled tulips). In the present embodiment, when a ball shot enters the special winning hole 53B as a special game-starting hole, this ball (referred to hereinafter as "the starting ball") is detected by a starting ball sensor 73, referred to hereinafter, and then variable display operation is started for the special game. Then, as a result of the special game, if the variable display terminates in a particular pattern, the special winning device 53C and other variable winning devices are changed from states disadvantageous to the player to states advantageous to the player. The arrangement of the ball-shooting game permitting the special game is conventionally known, and the present embodiment incorporates such arrangement.

On an operating panel 54 sloping up from a lower part of the front panel to the glass window, there are arranged a coin entry slot 55, a C/P (credit/payout) switch 56, a local credit display 57 and a bank credit display 58. Each of the displays is formed of 7-segment LED's for displaying a numerical value in a desired number of (e.g. two) digits.

Further, at the bottom of the front face of the game machine, there are arranged a handle 59 for shooting balls, a coin payout chute 60, a coin tray 61 and a speaker opening 62.

When the game is played, the player operates the handle 59 to permit a ball shooter 89 (see FIG. 8) arranged below the game board 53 to shoot a ball onto the game board 53.

It is possible to shoot a predetermined number of (e.g. 20) balls per coin inserted into the machine. When the ball falls across the game board without entering any winning hole or device, it is discharged from a ball outlet port (so-called out port) provided at the bottom of the game board to be collected for use in another play. Further, if the ball shot from the ball shooter 89 does not reach the top of the game board to return toward the ball shooter 89, the returned ball drops into a collection passage for use in another play as well.

Further, above the game board 53, there are arranged an alarm lamp 63 for giving an alarm when the numerical value of coins deposited as credit and the number of balls corresponding thereto are smaller than respective predetermined values, as well as a trouble alarm lamp 64 adapted to be lighted when various kinds of trouble have occurred.

In this embodiment, the awards (local credit) given to the player are represented by the number of coins to be actually paid out, and the rights of playing the game (bank credit or the second gaming value) owned by the player are represented by the number of balls.

At the display block, the local credit display 57 displays, as the local credit, the number of coins at the time of insertion of coins into the machine, and thereafter, a numerical value obtained by converting tile bank credit (in the present case, the number of balls representative of the number of plays permitted) into the number of coins to be paid out to the player, at a second conversion factor $R_2$. 0n the other hand, the bank credit display 58 displays, as the bank credit, a numerical value obtained by converting the number of medals inserted to the machine into the number of balls at a first conversion factor $R_1$, at the time of insertion of coins, and thereafter, the number of balls which are increased by winning plays or decreased by losing plays.

The present embodiment is characterized in that a coin-to-ball conversion factor (the first conversion factor $R_1$) applied when the player inserts coins into the machine, and a ball-to-coin conversion factor (the second conversion factor $R_2$) applied when the player acquired balls through winning plays in the game can be set to different values. The latter, i.e. the ball-to-coin conversion factor can be set by operating a switch when the machine starts to be put into operation, or alternatively can be determined by selecting from a predetermined plurality of numerical values by the use of a random number.

Figure 8:
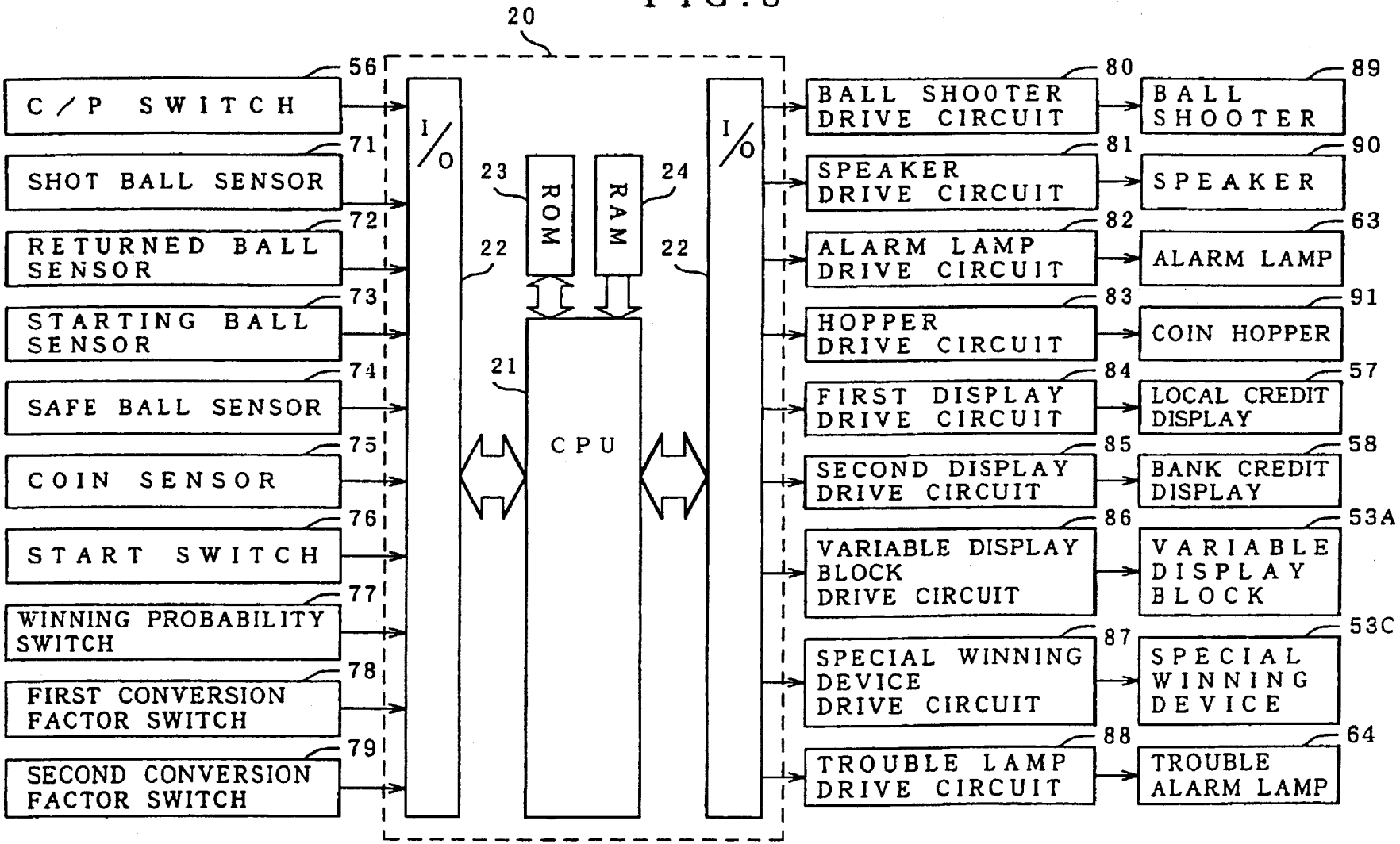
FIG. 8 is a diagram showing a configuration of a control circuitry used in the pachinko game machine shown in FIG. 7.

FIG. 8 shows a control circuitry of the ball-shooting game machine (pachinko game machine) according to the embodiment. This control circuitry operates, similarly to the first embodiment shown in FIG. 2, under the control of a microcomputer 20. The microcomputer 20 is comprised of a CPU (central processing unit) 21, I/0 ports (input/output ports) 22, 22, a ROM (read only memory) 23, and a RAM (random access memory) 24. The CPU 21 receives signals from the following sensors and switches.

First, a shot ball sensor 71 detects a ball shot from the above-mentioned ball shooter, and is suitably formed by a magnetic sensor arranged at an open end (shooting port) of the ball shooter.

A returned ball sensor 72 detects, as described hereinabove, a ball which is shot but does not reach the top of the game board to return to the bali shooter, and is suitably formed by a magnetic sensor arranged at the collection passage at the back of the game board 3.

A start ball sensor 73 detects, as described hereinabove, a ball (starting ball) entered the special winning hole 53B, and is formed e.g. by a microswitch.

A safe ball sensor 74 detects balls (safe balls) entered the special winning hole 53B, the special winning device 53C, the ordinary winning holes 53D and the variable winning devices, and are formed by microswitches as well as proximity sensors or the like.

The C/P (credit/payout) switch 56 is arranged on the front face of the gaming machine 51 as described above, and is manually operated for a changeover between the credit side and the payout side.

In the present embodiment, the number of coins as the local credit and the number of balls as the bank credit are displayed on the respective displays, and so long as the player holds the C/P switch 56 at the credit side, no coins are paid out for wining plays, but the numerical value of the bank credit and that of the local credit corresponding thereto are increased instead. On the other hand, when the C/P switch 56 is changed over to the payout side, the CPU 21 determines whether the numerical value of the bank credit is equal to or higher than a lower limit value for payout of a coin. If the answer to this question is affirmative (YES), coins are paid out which correspond in number to the local credit converted from the numerical value of the bank credit. If the answer is negative (NO), no medals are paid out, while permitting the player to continue the game depending on an amount of the remaining bank credit.

A coin sensor 75 detects a proper coin entered via the coin entry slot 55 and selected by a coin selector, not shown, and is suitably formed by a contact type detector, such as a microswitch, as well as a non-contacting type detector, such as a magnetic sensor or an optical sensor.

A start switch 76 detects an operation of the handle 59 described above, to generate a start signal, and is turned on or off in a manner interlocked with the handle 59 operated by the player.

The winning probability switch 77 is provided for setting a ratio of a total number of balls paid out to a player for winning plays to a total number of balls shot out by the player, i.e. a payout ratio which is determined by a probability of occurrence of winning plays, through selection from two or a larger number of predetermined numerical values. The construction thereof is similar to that of the first embodiment. The winning probability is set, e.g. as shown in Table 1, described hereinabove.

The first conversion factor switch 78 is provided for setting the first conversion factor $R_1$ (for example, "8" in the case of eight balls being supplied per coin entered) for calculating the number $B_0$ of balls (bank credit) supplied for the number $L_0$ of coins inserted by the player, by selecting from two or a larger number of predetermined values.

The first conversion factor $R_1$ is set, e.g. as shown in Table 4.

TABLE 4

| Stage | $R_1$ (= $L_0/B_0$) |
|---|---|
| 1 | 1/20 |
| 2 | 1/25 |
| 3 | 1/30 |
| 4 | 1/35 |
| 5 | 1/40 |
| 6 | 1/45 |

The second conversion factor switch 79 is provided for setting the second conversion factor $R_2$ for converting the bank credit $B_1$ (in the present case, the number of balls) acquired by the player into the local credit (the number of coins to be actually paid out) by selecting from two or a larger number of predetermined values.

The second conversion factor $R_2$ is set, e.g. as shown in Table 5.

TABLE 5

| Stage | $R_2$ (= $L_1/B_1$) |
|---|---|
| 1 | $R_1 \times 10/10$ |
| 2 | $R_1 \times 9/10$ |
| 3 | $R_1 \times 8/10$ |
| 4 | $R_1 \times 7/10$ |
| 5 | $R_1 \times 6/10$ |
| 6 | $R_1 \times 5/10$ |

According to the example described above, assuming that the first conversion factor switch 78 is set to a stage "1", and the second conversion factor switch 79 to a stage "5", the player acquires 20 balls as the bank credit when one coin is inserted into the machine. Then, if the player possesses 400 balls when he intends to be paid out as coins, 12 ($400 \times 1/20 \times 6/10$) coins as the local credit are paid out. When the above conversion factors $R_1$ and $R_2$ are set by random numbers instead of manual setting operations by the use of switches, one of the plurality of the stages of each of them is determined by a value selected by random number sampling by the CPU 21.

The CPU 21 of the microcomputer 20 is supplied with signals delivered from the above-mentioned various sensors and switches, and writes detected results as data into the RAM 24, and also operates to drive an operating block, described below.

The operating block of the pachinko game machine 51 is formed by the variable display block 53A, the special winning device 53C, the local credit display 57, the bank credit display 58, the alarm lamp 63, the trouble alarm lamp 64, as well as the ball shooter 89 as means for shooting balls required in plays, the speaker 90 for generating effects, alarms, and other sounds, a coin hopper 91 for holding coins to be dispensed to the player, and drive circuits 80 to 88 for driving these devices, respectively.

In the second embodiment, the first conversion factor switch 78 and the microcomputer 20 constitute first converting means for converting the effective value of gaming media (the number of coins inserted by the player) into the second gaming value (bank credit) at the first conversion factor $R_1$, while the second conversion factor switch 79 and the microcomputer 20 constitute second converting means for converting the second gaming value (bank credit) decreased or increased during the game, into the first gaming value (local credit) at the second conversion factor $R_2$.

Next, there will be described gaming operations performed by the pachinko game machine under the control of the control circuitry shown in FIG. 8.

Figure 9:
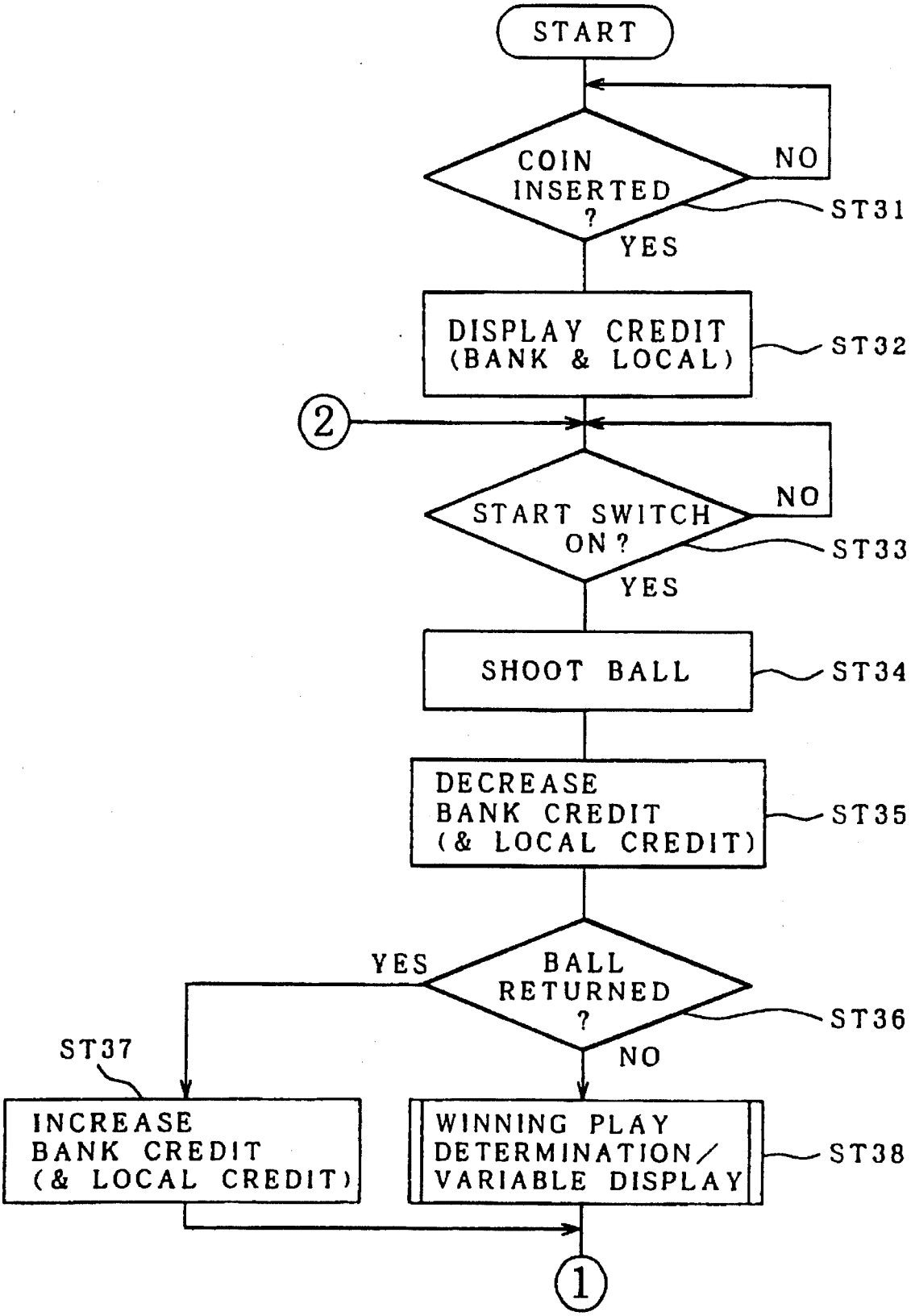
FIG. 9 is a flowchart of a program for gaming operations performed by the control circuitry shown in FIG. 8.

Referring to FIG. 9, the CPU 21 determines at a step ST31 whether or not a coin is inserted. The answer to this determination becomes affirmative (YES), when the coin is inserted into the coin entry slot 55, and a detection signal from the coin sensor 75 is applied to the computer 20 when the coin entered is a proper one. If the answer is affirmative (YES), the local credit and the bank credit are displayed at a step ST32. More specifically, the number of coins inserted into the machine is displayed at the local credit display 57, while a numerical value obtained by converting the number of these coins into the number of balls at the first conversion factor $R_1$ is displayed at the bank credit display 58.

Then, it is determined at a step ST33, whether or not the starting switch has been turned on, i.e. whether or not the handle 9 has been operated. If the starting switch has been turned on, a ball is shot. More specifically, as the player operates the handle 59, the CPU 21 drives via a ball shooter drive circuit 80 a power source (e.g. solenoid or motor) of the ball shooter 89, thereby permitting a ball to be shot onto the game board. Whenever the shot ball sensor 71 detects a ball shot by this shooting operation, the number of balls displayed on the bank credit display is decreased by one at a step ST35. The number of coins displayed on the local credit display 57 is equal to an integer obtained by ignoring decimal fractions of a numerical value obtained by converting the number of balls displayed on the bank credit display 58 at the second conversion factor $R_2$. For example, assuming that the number of balls is equal to 28, and settings are $R_1=1/20$, and $R_2=R_1 \times 8/10$, there results $28 \times 1/20 \times 8/10=1.12$, and accordingly, the number of coins as the local credit is displayed as "1".

When no detection signal is delivered from the shot ball sensor 71 upon shooting operation, it is judged that some trouble has occurred, and the CPU 21 operates to light the trouble alarm 64 via a trouble alarm drive circuit 88.

Then, the CPU 21 determines based on a signal from the returned ball sensor 72 at a step ST36 whether there is a returned ball. Whenever a returned ball is detected, the number of balls displayed on the bank credit display 58 is increased by one at a step ST37, and then the program proceeds to a step ST39, where a winning ball detection, described hereinafter, is performed.

On the other hand, if no returned ball is detected, winning play determination and variable display are performed at a step ST38. These operations are performed in the following manner:

First, random number sampling is performed. More specifically, similarly to the first embodiment described above, an integer stored within a register in the CPU 21 is changed within a predetermined range (e.g. 0 to 127) whenever a reference clock pulse is received from the clock pulse generator 25. Then, during an interval between one interruption and the following interruption, a numerical value obtained by adding a predetermined number (e.g. 3) to this integer is stored in the RAM 24, and the resulting numerical value stored in the RAM 24 is read out whenever the interruption operation occurs, thereby effecting random number sampling. The numerical value stored in the RAM 24 is updated during an interval between one interruption and the following interruption.

Then, it is determined whether or not a winning play has occurred based on the random number value sampled or read out from the RAM 23. The determination of a winning play is performed by comparing the sampled random number value with a winning probability table stored within the ROM 23 selected for use to thereby determine a kind of a winning play or a losing play. Depending on the result of comparison, a flag indicative of a kind of the winning play (e.g. a big prize or a prize other than the big prize) or one indicative of "a losing play" is set.

Then, it is determined whether or not a starting ball is detected by the starting ball sensor 73. If the starting ball is detected, the CPU 21 operates to drive the variable display block 53A via a variable display block drive circuit 86 based on the above flag, thereby performing variable display operation. Then, if a final pattern of display indicated by the above flag is one for a winning play, the winning drive control is performed. For example, if the result of determination is "the big prize", the CPU 21 performs the driving operation such that a predetermined display pattern (e.g. "777") appears on the final status of variable display, and then drives the special winning device 53C via a special winning device drive circuit 87 such that it is changed over from a state disadvantageous to the player to a state advantageous to the player.

Figure 10:
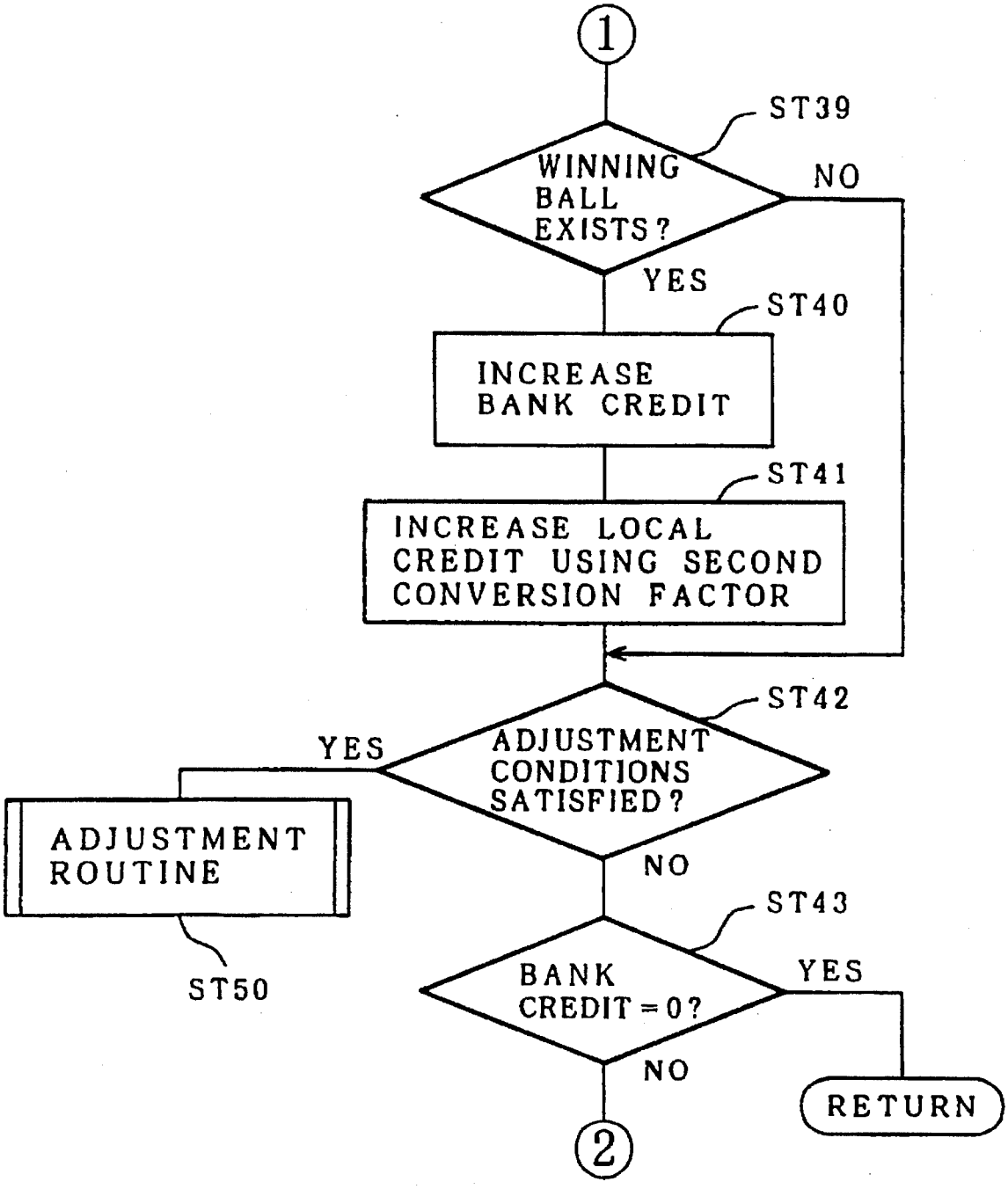
FIG. 10 is a continuation of the FIG. 9 flowchart.

Then, a winning ball detecting operation is performed at a step ST39 in FIG. 10. More specifically, the CPU 21 determines whether or not a safe ball (winning ball) is detected by the safe ball sensor 74 to have entered any of the special winning hole 53B, the special winning device 53C, the ordinary winning holes 53D, and the variable winning devices. If no safe ball is detected, the program jumps over to a step ST42, whereas if any safe ball is detected, the number of balls determined based on a predetermined payout ratio (e.g. 10 balls per safe ball) is added to the number displayed on the bank credit display 58 at a step ST40. Then, the number of coins resulting from conversion at the second conversion factor $R_2$ is displayed on the local credit display 57 at a step ST41.

Then, it is determined at the step ST42 whether or not the adjustment conditions are satisfied. If the answer to this question is negative (NO), it is determined at a step ST43 whether or not the bank credit is equal to zero (0). If the answer to this question is affirmative (YES), the program returns to the step ST31, whereas if the answer is negative (NO), the program returns to the step ST33.

Figure 11:
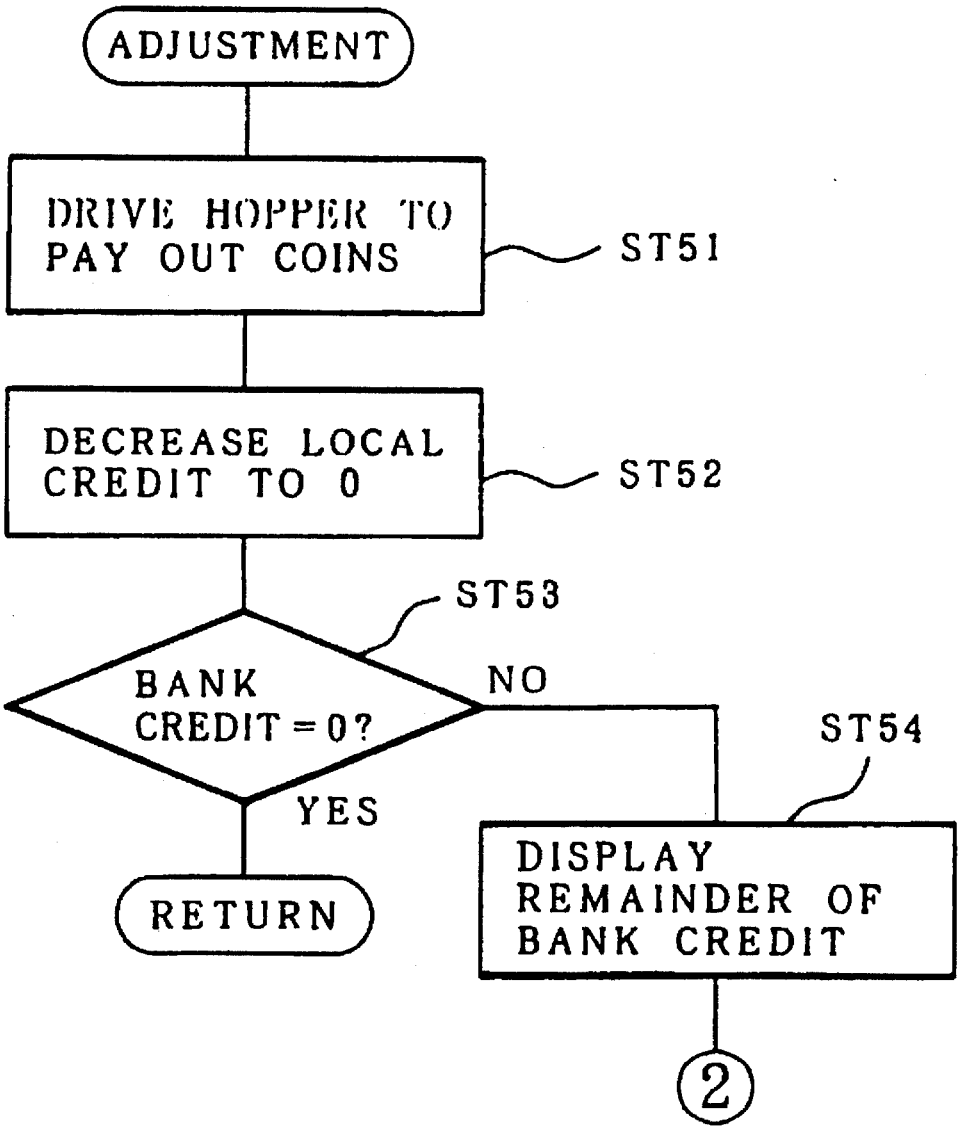
FIG. 11 is a flowchart of an adjustment routine executed in the FIG. 10 program.

On the other hand, if the adjustment conditions are satisfied at the step ST42, an adjustment routine shown in FIG. 11 is executed at a step S50. The adjustment routine is basically identical to the routine described above with reference to FIG. 5. The adjustment conditions in the present embodiment are defined by one or a combination of the following cases: (1) The C/P switch 56 is changed over to the payout side. (2) The adjustment switch is turned on. (3) A predetermined time period has elapsed after the game is started by insertion of a coin. (4) The difference between a total number of coins inserted by the player and a total number of coins acquired through plays becomes equal to or larger than a predetermined value. The adjustment switch is an internal switch (software switch set by a program) which is automatically turned on by the CPU21, when the big prize has occurred a predetermined number of times (set in advance e.g. by a number of times-setting switch), and the final big prize is terminated. Or alternatively, the random number sampling may be performed upon termination of each big prize, and if the random number sampled is equal to one of predetermined numbers, the adjustment is not performed (i.e. permitting the bank credit to remain deposited for continuation of the game), and if not, the adjustment is performed, i.e. the coins are paid out. These adjustment conditions may be adopted as desired.

Further, it is also possible to make the adjustment conditions easier to be satisfied as the winning probability set in advance is higher. In this case, the gaming machine which is set to a higher winning probability is more often subjected to adjustment of the credit, i.e. payout of coins.

Referring now to the adjustment routine shown in FIG. 11, the coin hopper 91 is driven to cause coins equal in number to the local credit to be paid out at a step ST51, and the local credit is finally set to 0 at a step ST52. Then, it is determined at a step ST53 whether there remains no bank credit. If the answer to this question is affirmative (YES), i.e. if there remains no bank credit, the program returns to the start of the program, i.e. the step ST31, whereas if the answer is negative (NO), the remaining value of the bank credit is displayed on the bank credit display 58 at a step ST54, followed by the program returning to the step ST33. Then, the player can further continue the game by the use of coins paid out.

According to the adjustment conditions described above, it is possible to timewise divide The game, and the number of coins paid out each time is converted from the bank credit at the second conversion factor $R_2$, enabling the chance hall side to secure profits.

As described above, in the pachinko game machine according to the second embodiment, the second conversion factor $R_2$ for converting the number of balls acquired by the player through plays into the number of coins (local credit) to be actually paid out can be set to a value smaller than the first conversion factor $R_1$ applied when converting the number of coins inserted by the player into the bank credit. Therefore, the payout ratio (winning probability) of the game for paying out winning balls can be set to a value higher than 100%. As a result, the probability of occurrence of the big prize can be set to a larger value to thereby increase the fun of playing the game. Accordingly, the rate of operation of the gaming machine can be increased by making players more interested in the game, which leads to an increase in sales.

Further, when the second conversion factor $R_2$ is determined by random number sampling, the conversion factor per se is varied, which makes it impossible for players to recognize the conversion factor, thereby increasing the fun of playing the game as compared with a case where the conversion factor is set to a fixed value by the use of a setting switch, and this is preferred from a viewpoint of management of a chance hall.

The second embodiment described above is an application to a pachinko game machine of ball-enclosed type. The present invention can be also applied to an ordinary pachinko game machine in which coins are not used.

Figure 12:
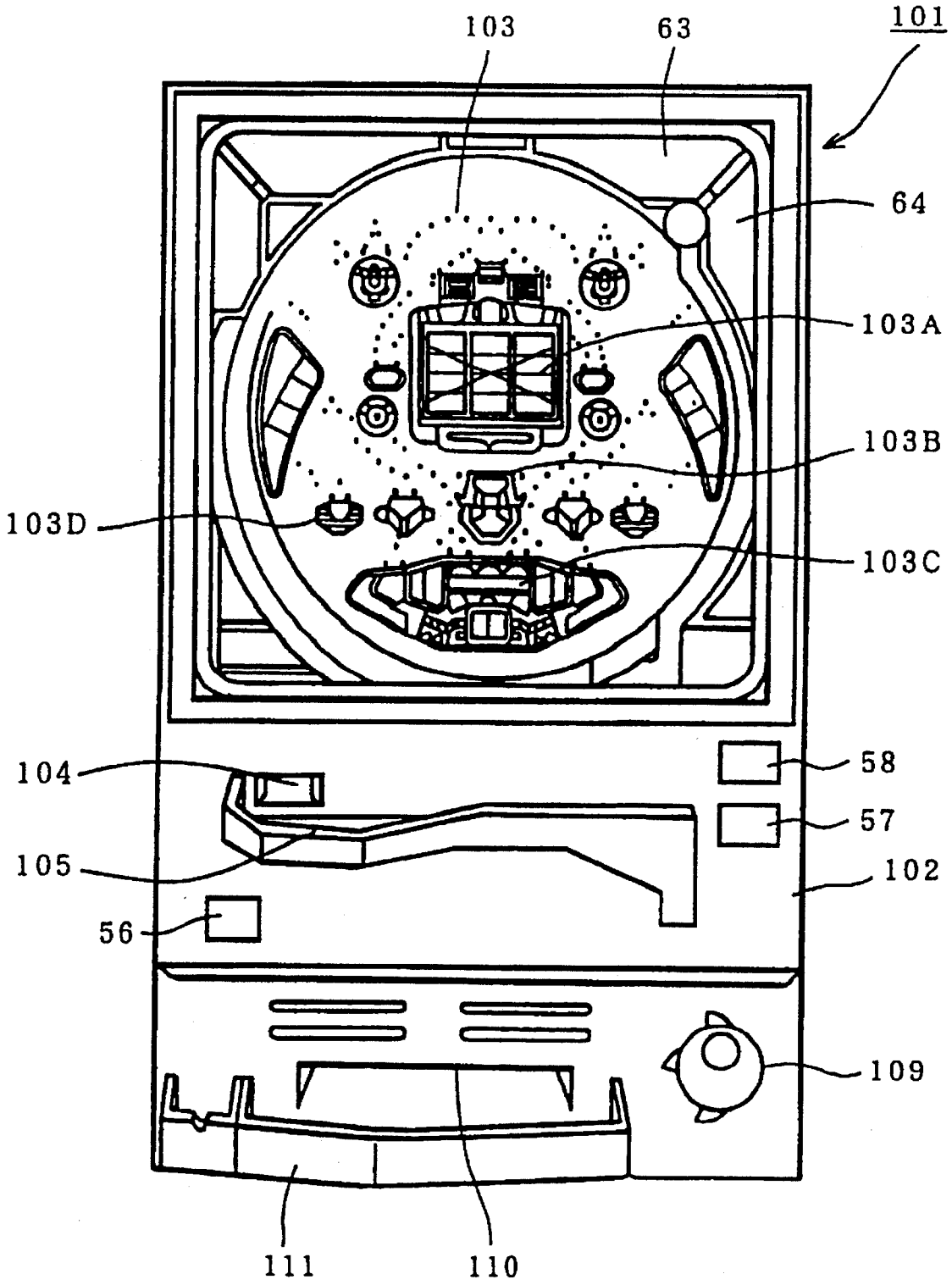
FIG. 12 is a perspective view showing an appearance of a pachinko game machine according to a third embodiment of the invention.
Figure 13:
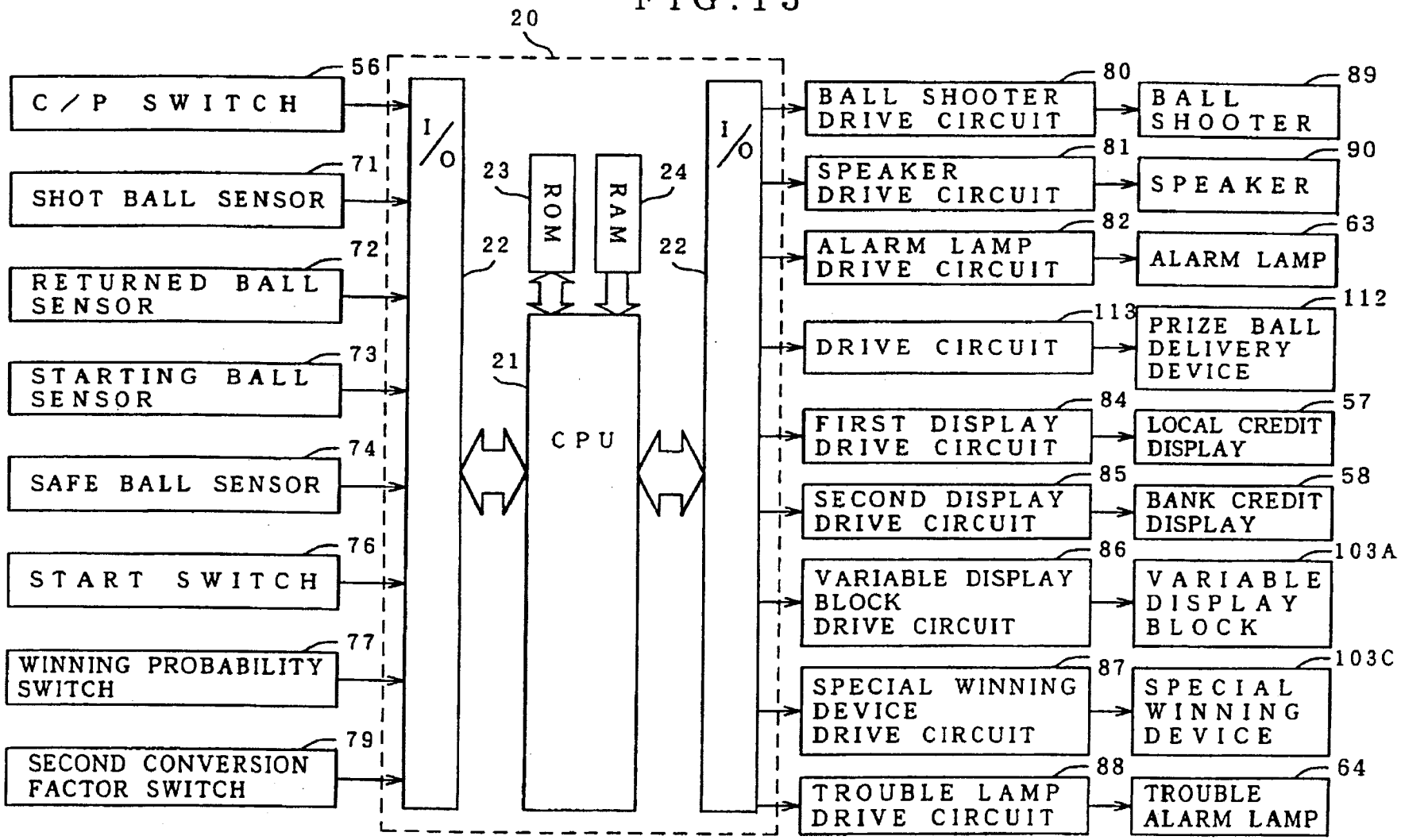
FIG. 13 is a diagram showing a configuration of a control circuitry used in the pachinko game machine shown in FIG. 12.

FIG. 12 and FIG. 13 show an example of such an ordinary pachinko game machine and a control circuitry thereof, respectively. Elements and component parts similar to those shown in FIG. 7 and FIG. 8 of the second embodiment are designated by identical reference numerals.

As shown in FIG. 12, inside a glass window covering an upper part of a front door 102 of a pachinko game machine 101, there is arranged a game board 103 which is formed, on a front surface thereof, a variable display block 103A for playing a special game other than an ordinary game played by the use of balls, as well as winning regions, such as a special winning hole 103B for permitting the variable display block 53A to start the special game, a special winning device 103C (so-called attacker) which is changed from a state disadvantageous to the player to a state advantageous to the player when the special game terminated in a particular winning pattern, or under other particular conditions, ordinary winning holes 103D, and other variable winning devices (so-called tulips).

In the present embodiment, when a shot ball enters the special winning hole 103B, this ball (the starting ball) is detected by a starting ball sensor 73 (see FIG. 13), and then variable display operation is started for the special game. Then, if the variable display by the special game has terminated in a particular pattern (indicative of a big prize), the special winning device 103C is changed from a closed state which is disadvantageous to the player to an opened state which is advantageous to the player. In this case, the special winning device 103C may continue to be opened for a predetermined time period, or alternatively be repeatedly opened and closed at intervals.

Below the game board 103, there are provided a ball outlet port 104 for delivering balls as an award for a winning play, and an upper tray 105 for receiving these balls awarded via the ball outlet port 104 and for storing balls to be charged into a ball shooter 89 (see FIG. 13). Further, below the upper tray 105, there are provided a ball shooting handle 109, a ball delivery chute 110, and a lower tray 111. Further, there are also provided a C/P (credit/payout) switch 56, a local credit display 57 and a bank credit display 58. Each of the displays is formed of 7-segment LED's for displaying a numerical value in a desired number of (e.g. two) digits.

Further, at the top of the game board 103, there are arranged an alarm lamp 63 for giving an alarm when the number of balls stored as awards is detected by a sensor, not shown, to be lower than a predetermine value, as well as a trouble alarm lamp 64 adapted to be lighted when various kinds of trouble have occurred.

In the game, the player operates the handle 109 to permit the ball shooter 89 to shoot a ball onto the game board 103. When the ball falls across the game board without entering any winning hole or device, it is discharged from an out port provided at the bottom of the game board 103. Further, if the ball shot from the ball shooter 89 does not reach the top of the game board to return toward the ball shooter 89, the returned ball drops into a collection passage below, and then returns to the lower tray 111 via the ball delivery chute 110.

In the present embodiment, the player starts the game, after he deposited bails purchased for a predetermined amount of money, in the upper tray 105. It should be noted that the balls purchased for money, i.e. the first gaming value (local credit) is directly used for plays. Therefore, the first conversion factor $R_1$ for converting the first gaming value into the second gaming value is set, in this embodiment, to 1. The first gaming value (local credit) is represented by the number of bails purchased by him at the start of the game and the number of balls to be actually paid out at the adjustment of credit, while the second gaming value (bank credit) is represented by the number of bails increased by winning plays without being paid out and decreased by losing plays.

Then, if a winning play occurs during the game, so long as the player holds the C/P switch 56 at the credit side, the profits (the number of award balls) acquired by the player are added to the bank credit. The bank credit display 58 displays the number of balls acquired by the player through winning plays, while the local credit display 57 displays the number of prize balls to be actually paid out which is calculated based on the second conversion factor $R_2$ from the number of these award balls for winning plays. So long as the player holds the C/P switch at the credit side, no prize bails are paid out, but instead, the bank credit is increased, and accordingly, the local credit obtained by conversion is increased.

If the player has set the C/P switch 56 to the payout side, the prize balls are paid out in a predetermined number dependent on the type of a prize, thereby decreasing the bank credit and the local credit.

The present embodiment is characterized in that a conversion factor (the first conversion factor $R_1$) applied for converting the number of balls purchased for money into the number of balls used in plays, and a conversion factor (the second conversion fact or $R_2$) applied for converting the number of award balls acquired in deposit by winning plays into the number of prize balls to be actually paid out, can be set to different values. The latter, i.e. the second conversion factor $R_2$ can be set by operating a second conversion factor switch 79 (see FIG. 13) when the machine starts to be put into operation, or alternatively be determined by selecting from a plurality of numerical values by the use of a random number.

FIG. 13 shows a circuitry configuration of the pachinko game machine 101. The control circuitry has a construction similar to that of the FIG. 8 control circuitry, and is adapted to control gaming operations by the use of the microcomputer 20. However, since no coins are used as gaming media, no coin sensor 75 appearing in FIG. 8 is provided. Further, in place of the coin hopper 91 and the drive circuit 83 therefor, there are provided a prize ball delivery device 112, and a drive circuit 113 therefor inside the pachinko game machine 101.

In the present embodiment, the winning probability switch 77 sets, as a probability of winning plays to occur during the game, a ratio of winning plays (and hence the award balls paid out in deposit) to the number of properly shot balls (the number of balls shot and detected by the shot ball sensor 71 minus the number of balls returned and detected by the returned ball sensor 72), by electing from predetermined two or more values. The winning probability is set as shown in FIG. 1, similarly to the first and second embodiments.

During the game, the microcomputer 20 performs random number sampling whenever a ball is shot, and determines a winning play by the use of a winning play determining table which is stored within the ROM and selected based on the winning probability set by the switch 77, to thereby generate a predetermined winning mode. In this connection, the shot ball sensor 71 and the returned ball sensor 72 are used in setting the winning probability. However, if such winning probability setting is not performed, it is not required to provide the winning probability switch 77, the shot ball sensor 71 and the returned ball sensor 72.

In the first and second embodiments, the first conversion factor for converting the local credit represented by the number of medals or coins as gaming media, into the bank credit, is set by way of the gaming machine. However, in the third embodiment, bails purchased are directly used for plays, and hence a purchased balls-to-shooting balls conversion ratio as the first conversion factor is equal to 1. Therefore, this pachinko game machine is not provided with the first conversion factor switch used in the first and second embodiments.

The second conversion factor switch 79 is provided for setting a second conversion factor $R_2$ for calculating the bank credit $B_1$ representative of rights of playing the game owned by the player (in the present embodiment, the number of shooting balls to be deposited as credit) into the local credit (the number of prize balls to be actually paid out) by selecting from two or a larger number of predetermined values.

Next, there will be described the gaming operations performed by the pachinko game machine under the control of the control circuitry thereof.

Figure 14:
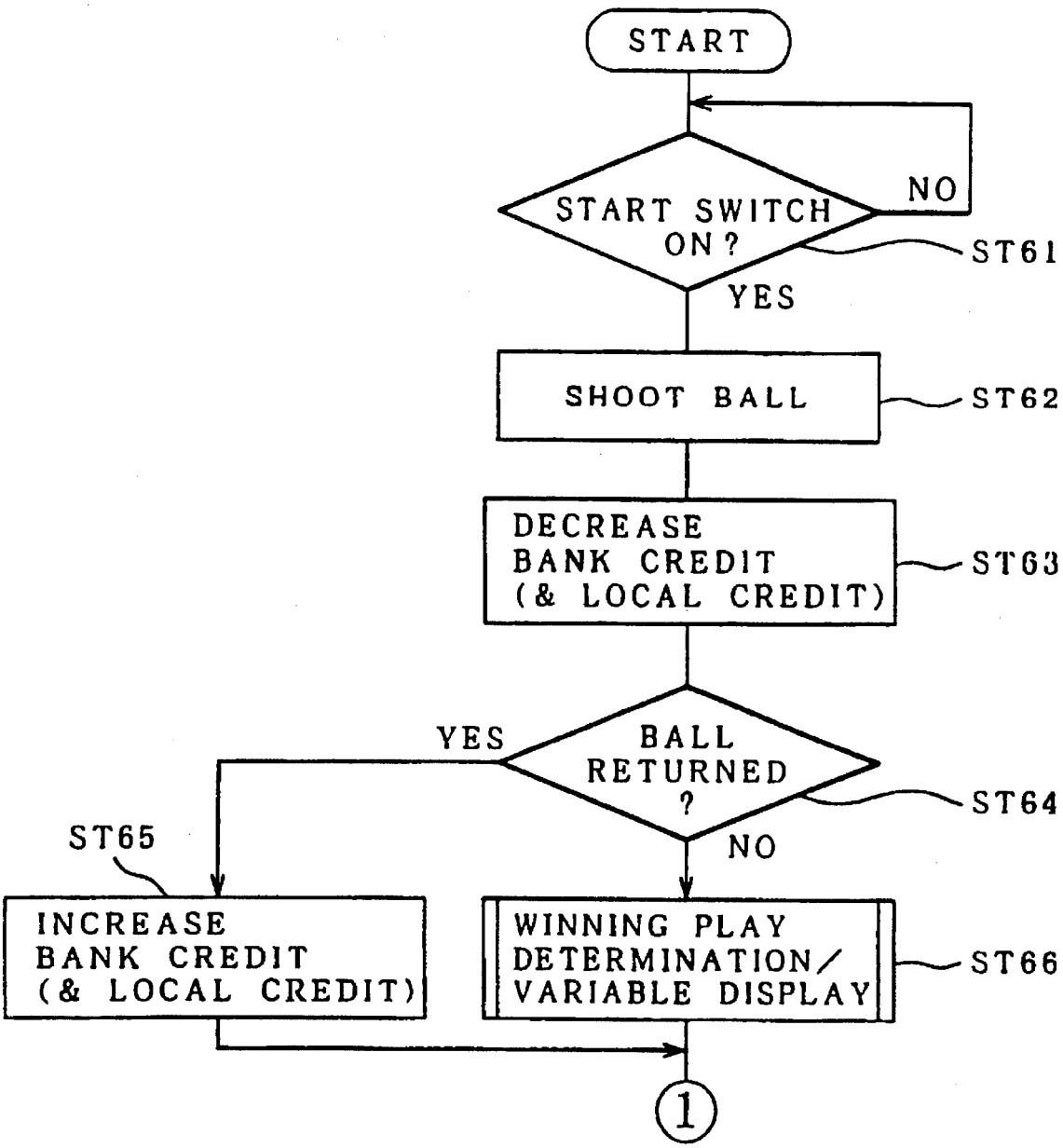
FIG. 14 is a flowchart of a program for gaming operations performed by the control circuitry shown in FIG. 13.

As shown in FIG. 14, the CPU 21 first determines at a step ST61 whether or not the starting switch 76 has been turned on, i.e. whether or not the handle 109 has been operated. If the starting switch 76 has been turned on, a ball is shot at a step ST62. Whenever the shot ball sensor 71 detects a ball shot by this shooting operation, the number of balls displayed on the bank credit display 58 is decreased by one at a step ST63, so long as it is not equal to "0". At this time, the number of prize balls to be actually paid out is displayed on the local credit display 57, as an integer obtained by ignoring decimal fractions of a numerical value obtained by converting the bank credit at the second conversion factor $R_2$.

Then, the CPU 21 determines based on a signal from the returned ball sensor 72 at a step ST64 whether there is a returned ball. Whenever a returned ball is detected, the number displayed on the bank credit display 58 is increased by one at a step ST65, and then the program proceeds to a step ST68, where a winning ball detection is performed as will be described with reference to FIG. 15. On the other hand, if no returned ball is detected, winning play determination and variable display are performed at a step ST66.

In this connection, if no winning probability setting is performed as described above, and the winning probability setting switch 77, the shot ball sensor 71, and the returned ball sensor 72 are not provided, the steps ST63 to ST65 are omitted.

The winning play determination and variable display operations at the step ST66 are as described in the second embodiment with reference to FIG. 9.

First, random number sampling is performed. More specifically, similarly to the first embodiment described above, an integer stored within a register within the CPU 21 is changed within a predetermined range (e.g. 0 to 127) whenever a reference clock pulse is received from the clock pulse generator 25. Then, during an interval between one interruption and the following interruption, a numerical value obtained by adding a predetermined number (e.g. 3) to this integer is stored in the RAM 24, and the resulting numerical value stored in the RAM 24 is read out whenever the interruption operation occurs, thereby effecting random number sampling. The numerical value stored in the RAM 24 is updated during an interval between one interruption and the following interruption.

Then, it is determined whether or not a winning play has occurred based on the random number value sampled or read out from the RAM 23. The determination of a winning play is performed by comparing the sampled random number value with a winning probability table stored within the ROM 23 to thereby determine a kind of a winning play. Depending on the result of comparison, a flag indicative of a kind of the winning play (e.g. one for a big prize or one for a prize other the big prize) or one indicative of the losing play is set.

Then, it is determined whether or not a starting ball is detected by the starting ball sensor 73. If the starting ball is detected, the CPU 21 operates to drive the variable display block 103A via the variable display block drive circuit 86 based on the above flag, thereby performing variable display operation. Then, if a final pattern of display indicated by the above flag is one for a winning play, the winning drive control is performed. For example, if the result of determination is "the big prize", the CPU 21 performs the driving operation such that a predetermined display pattern (e.g. "777") appears on the final status of variable display, and then drives the special winning device 103C via a special winning device drive circuit 87 such that it is changed over from a state disadvantageous to the player to a state advantageous to the player.

Figure 15:
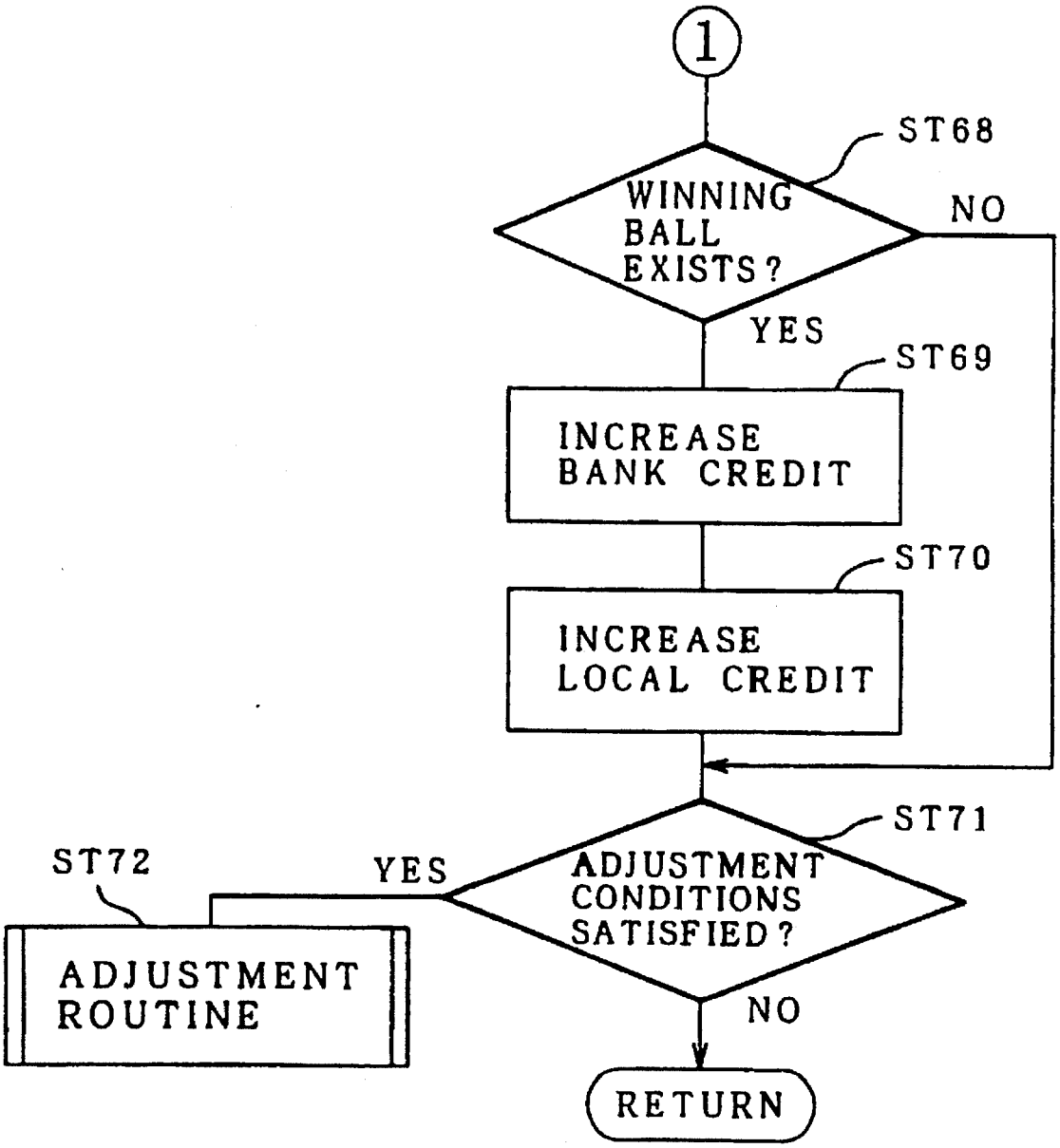
FIG. 15 is a continuation of the FIG. 14 flowchart.

Then, a winning ball detecting operation is performed at a step ST68 in FIG. 15. More specifically, the CPU 21 determines whether or not a safe ball is detected by the safe ball sensor 74 to have entered any of the special winning hole 103B, the special winning device 103C, the ordinary winning holes 103D, and the variable winning devices. If any safe ball is detected, the number of balls determined based on a predetermined payout ratio (e.g. 10 balls per safe ball) is added to the number displayed on the bank credit display 58 at a step ST69. Then, the number of coins resulting from conversion at the second conversion factor is displayed on the local credit display 57 at a step ST70.

Then, it is determined at a step ST71 whether or not the adjustment conditions are satisfied. If the answer to this question is negative (NO), the program returns to the start thereof, i.e. to the step ST61, whereas if the answer is affirmative (YES), i.e. if the adjustment conditions are satisfied, the adjustment routine is executed at the step ST72.

Figure 16:
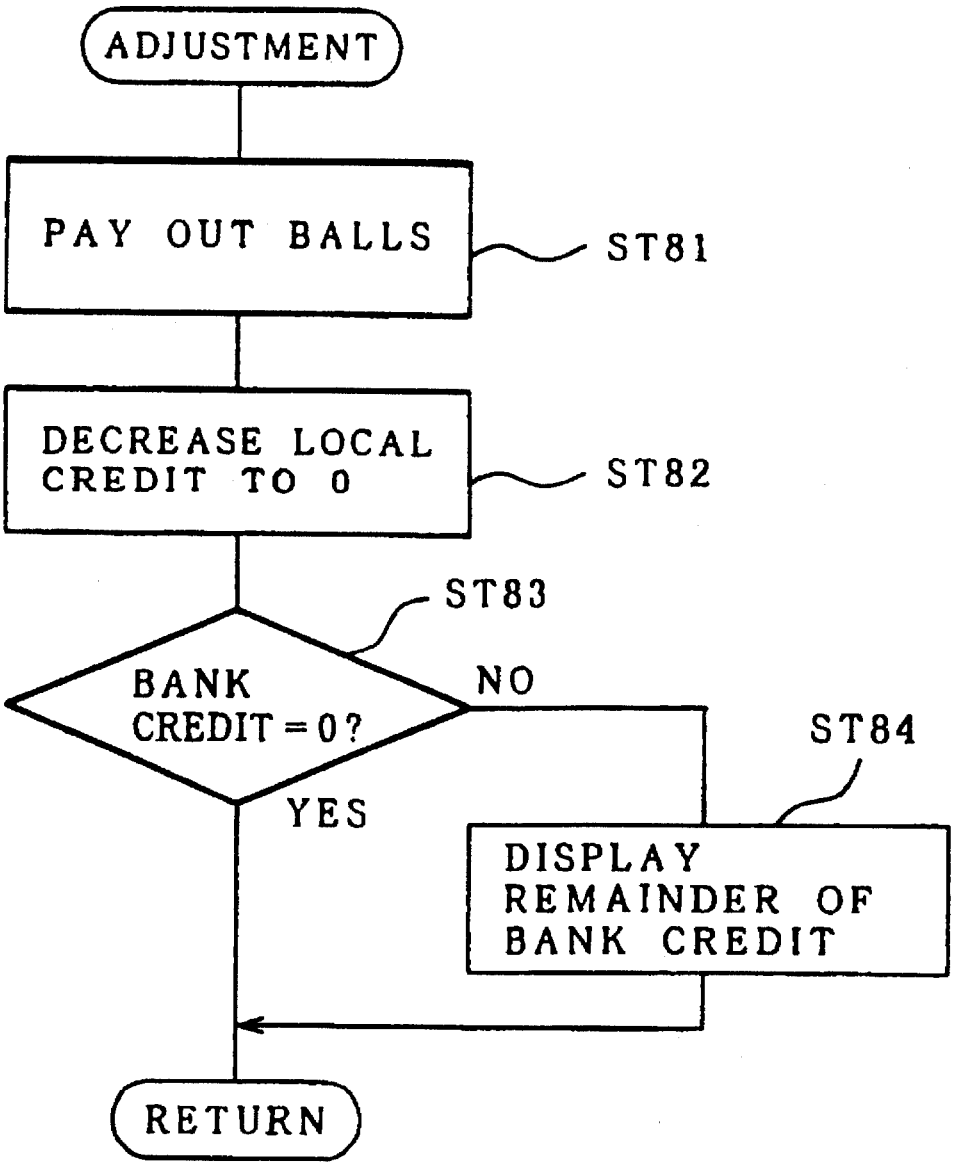
FIG. 16 is a flowchart of an adjustment routine executed in the FIG. 15 program.

As shown in FIG. 16, a prize ball delivery device 112 is driven to pay out the prize balls deposited as the local credit at a step ST81, and the local credit is finally set to 0 at a step ST82. Then, it is determined at a step ST83 whether there remains no bank credit. If the answer to this question is affirmative (YES), i.e. if there remains no bank credit, the program returns to the start of the program, i.e. the step ST61 in FIG. 14, whereas if the answer is negative (NO), the remaining value of the bank credit is displayed on the bank credit display 58 at a step ST84, followed by the program returning to the step ST61. Then, the player can further continue the game by the use of prize balls paid out.

According to the adjustment conditions described above, it is possible to timewise divide the game, and the number of prize balls paid out each time is converted from the bank credit at the second conversion factor, enabling the chance hall side to secure profits.

As described above, in the pachinko game machine according to the third embodiment, the second conversion factor $R_2$ for converting the profits acquired by the player through plays into the number of balls to be actually paid out can be set to a value smaller than the first conversion factor $R_1$ ( in the present embodiment, equal to 1 ) applied when the game is started. Therefore, the payout ratio (winning probability) for paying out the shooting balls as bank credit can be set to a value higher than 100%. As a result, the probability of occurrence of the big prize can be set to a larger value to thereby increase the fun of playing the game. Accordingly, the rate of operation of the gaming machine can be increased by making players more interested in the game, which leads to an increase in sales.

In the third embodiment, description is made of the pachinko game machine equipped with the winning probability switch 77, the shot ball sensor 71, and the returned ball sensor 72. In the case of a conventional pachinko game machine which is not equipped with these devices, the gaming operations shown in FIG. 14 are performed by omitting the winning probability setting and detections of shot balls and returned balls. More specifically, the steps S63 and ST65 are omitted, and the determination at the step ST64 is changed into determination whether a signal has been received from the starting ball sensor 37.

The present invention is by no means limited to the preferred embodiments described above by way of example. For example, the gaming media is not restricted to medals or balls as tokens, but there may be employed a prepaid card, such as a magnetic card and an IC card. That is, the gaming machine may be arranged such that a player inserts a writable/readable card into a predetermined slot provided in the gaming machine to start playing the game, and when the game is terminated, the remaining credit is stored into the card. The present invention can be applied not only to the above described gaming machines but also to gaming machines for a video poker game, a bingo game, a kino game, a black jack game, and a horse race game.

What is claimed is:

1. A gaming machine for the playing of a game by a player against a gaming establishment, the game being played with the use of gaming media, the number of which being increased or decreased in response to the results of the playing of the game, the gaming machine comprising:

first conversion factor setting means for setting a first conversion factor that is used for converting a first gaming defined by a value of the gaming media given to the player into a second gaming value defined by rights of the player for playing the game; and second conversion factor setting means for setting a second conversion factor that is used for converting the second gaming value into the first gaming value separately from the first conversion factor;

wherein a winning value won as a prize by the player in response to the playing of the game is obtained from the gaming establishment.

2. A gaming machine according to claim 1, wherein the first conversion factor setting means includes switch means for selecting a desired one of a plurality of predetermined values and thereby setting the first conversion factor.

3. A gaming machine according to claim 1, wherein said first conversion factor setting means comprises means for determining the first conversion factor in response to a randomly generated number.

4. A gaming machine according to claim 1, wherein said second conversion factor setting means includes switch means for selecting one of a plurality of predetermined values for setting the second conversion factor.

5. A gaming machine according to claim 2, wherein said second conversion factor setting means comprises switch means for selecting one of a plurality of predetermined values for setting the second conversion factor.

6. A gaming machine according to claim 3, wherein said second conversion factor setting means comprises switch means for selecting one of a plurality of predetermined values for setting the second conversion factor.

7. A gaming machine according to claim 1, where in said second conversion factor setting means comprises means for determining the second conversion factor in response to a randomly generated number after the second gaming value is increased or decreased.

8. A gaming machine according to claim 2, wherein said second conversion factor setting means comprises means for determining the second conversion factor in response to a randomly generated number after the second gaming value is increased or decreased.

9. A gaming machine according to claim 3, wherein said second conversion factor setting means comprises means for determining the second conversion factor in response to a randomly generated number after the second gaming value is increased or decreased.

10. A gaming machine according to claim 1, further comprising:

first display means for displaying the second gaming value; and second display means for displaying the first gaming value.

11. A gaming machine according to claim 1, further comprising:

first converting means for converting the first gaming value into the second gaming value using the first conversion factor; an second converting means for converting the second gaming value into the first gaming value using the second conversion factor.

12. A gaming machine according to claim 11, wherein the first gaming value corresponds to the number of gaming media, and the second gaming value corresponds to the number of plays remaining when wagering a minimum amount.

13. A gaming machine according to claim 11, further comprising:

first display means for displaying the second gaming value in response to the conversion by said first converting means; and second display means for displaying the first gaming value in response to the conversion by said second converting means.

14. A gaming machine according to claim 13; wherein said first display means displays the number of plays remaining when wagering the minimum amount, and said second display means displays the number of the gaming media.

15. A gaming machine according to claim 1, wherein the first gaming value corresponds to the number of gaming media, and the second gaming value corresponds to the number of plays remaining when wagering a minimum amount.

16. A gaming machine according to claim 15, wherein said gaming media are medals or coins.

17. A gaming machine according to claim 15, wherein said gaming media are medals or coins, and the game is played with the use of playing balls which are increased or decreased in number depending on results of the play of the game, and wherein the number of plays remaining when wagering a minimum amount corresponds to the number of said playing balls.

18. A gaming machine according to claim 15, wherein playing balls are used as said gaming media, and the game is played by the use of said playing balls which are increased or decreased in number depending on results of the play of the game, and the first conversion factor is correspondingly set to 1.

19. A gaming machine according to claim 1, further comprising means for paying out a number of gaming media corresponding to the first gaming value to the player, when a predetermined adjustment condition has been satisfied during the game.

20. A gaming machine according to claim 1, wherein when a number of said gaming media corresponding to the first gaming value are paid out to the player, the game being permitted to be continued unless the remaining value of the second gaming value is equal to 0.

21. A gaming machine for playing against a gaming establishment a game using gaming media, the number of which being increased or decreased in response to the results of the playing of the game, the gaming machine comprising:

means for increasing or decreasing the maximum number of plays of the game in response to the playing of the game;

means for converting the number of gaming media into the maximum number of plays of the game using a first conversion factor; and means for converting the maximum number of plays of the game into the number of said gaming media using a second conversion factor which is set separately of the first conversion factor;

wherein a winning value won as a prize in response to the playing of the game is obtained from the gaming establishment.

* * * * *

UNITED STATES PATENT AND TRADEMARK OFFICE

CERTIFICATE OF CORRECTION

PATENT NO. : 5,603,659

DATED : February 18, 1997

INVENTOR(S) : Kazuo Okada

It is certified that error appears in the above-indentified patent and that said Letters Patent is hereby corrected as shown below:

Col. 1, line 26, change "flaming" to -- gaming --;

Col. 2, line 29, delete "the" (second occurrence);

Col. 4, line 53, change "8L, 8C, and 8R" to -- 3L, 3C, and 3R --;

Col. 5, line 32, change "play." to -- play, --;

Col. 5, line 52, change "Of" to -- of --;

Col. 5, line 55, change "below" to -- hereinbelow --;

Col. 5, line 66, change "herein" to -- hereinbelow --;

Col. 6, line 21, change "wining" to -- winning --;

Col. 7, line 50, change "operation, " to -- operation --;

Col. 8, line 12, change "Cat" to -- (at --;

Col. 8, line 18, change "Fractions" to -- fractions --;

Col. 9, line 23, change "STG" to -- ST6 --;

Col. 9, line 39, change "RAM 23" to -- RAM 24 --;

Col. 9, line 61, change "a" to -- an --;

Col. 10, line 5, change "above" to -- hereinabove --;

Col. 10, lines 57 - 60, change "ST3. In this connection, if it is set that the remainder, if any, of the bank credit, which is continue the game by the use of medals paid out." to -- ST3. In this connection, if the remainder of the bank credit is less than one but rounded up and set to one, the player can continue the game by the use of medals paid out. --;

UNITED STATES PATENT AND TRADEMARK OFFICE

CERTIFICATE OF CORRECTION

PATENT NO. : 5,603,659

DATED : February 18, 1997

INVENTOR(S) : Kazuo Okada

It is certified that error appears in the above-indentified patent and that said Letters Patent is hereby corrected as shown below:

Col. 12, line 41, change "socalled" to -- so-called --;

Col. 13, line 61, change "bali" to -- ball --;

Col. 14, line 14, change "wining" to -- winning --;

Col. 16, line 48, change "RAM 23" to -- RAM 24 --;

Col. 19, line 13, change "predetermine" to -- predetermined --;

Col. 19, line 61, change "fact or" to -- factor --;

Col. 20, line 65, change "ignoring" to -- ingoing --;

Col. 21, line 34, change "RAM 23" to -- RAM 24 --;

Col. 22, line 47, change "S63" to -- ST63 --;

Col. 23, line 6, delete the entire line and replace with -- gaming value defined by a number of gaming media given --;

Col. 23, line 36, change "where in" to -- wherein --;

Col. 23, line 61, change "an" to -- and --.

Signed and Sealed this

Fifth Day of August, 1997

Bruce Lehman

*Attest:*

BRUCE LEHMAN

*Attesting Officer*

*Commissioner of Patents and Trademarks*